US010216112B2

(12) United States Patent
Sasame et al.

(10) Patent No.: US 10,216,112 B2
(45) Date of Patent: Feb. 26, 2019

(54) IMAGE FORMING APPARATUS

(71) Applicant: CANON KABUSHIKI KAISHA, Tokyo (JP)

(72) Inventors: Hiroki Sasame, Ichikawa (JP); Kohei Okayasu, Mishima (JP); Shinsuke Kobayashi, Yokohama (JP); Takaaki Akamatsu, Yokohama (JP); Kenji Shindo, Yokohama (JP); Takehiko Suzuki, Yokohama (JP); Hironori Kato, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/653,218

(22) Filed: Jul. 18, 2017

(65) Prior Publication Data

US 2018/0024458 A1 Jan. 25, 2018

(30) Foreign Application Priority Data

Jul. 22, 2016 (JP) ..... 2016-143918

(51) Int. Cl.
*G03G 15/01* (2006.01)
*G03G 15/02* (2006.01)
(Continued)

(52) U.S. Cl.
CPC ..... *G03G 15/0225* (2013.01); *G03G 15/043* (2013.01); *G03G 15/0868* (2013.01); *G03G 15/0189* (2013.01); *G03G 2215/0161* (2013.01)

(58) Field of Classification Search
CPC ..... G03G 15/0189; G03G 15/0225; G03G 15/043; G03G 15/0834; G03G 2215/0161;
(Continued)

(56) References Cited

U.S. PATENT DOCUMENTS 4,669,864 A * 6/1987 Shoji ..... G03G 21/0005 399/349
4,772,253 A * 9/1988 Koizumi ..... B32B 15/04 474/266
(Continued)

FOREIGN PATENT DOCUMENTS

JP 8-137368 A 5/1996
JP 11-237825 A 8/1999
(Continued)

*Primary Examiner* — Negussie Worku
(74) *Attorney, Agent, or Firm* — Canon U.S.A., Inc. IP Division

(57) ABSTRACT

An image forming apparatus includes a developing unit which develops a toner image on a surface of a photosensitive member and which collects toner which remains on the surface of the photosensitive member after the developed toner image is transferred to a transfer member. The image forming apparatus includes a controller configured to determine whether a cleaning operation of cleaning the surface of the photosensitive member is to be performed after an image forming operation is performed or control a period of time in which the cleaning operation is performed in accordance with a measured downtime of the image forming apparatus which is a period of time after the image forming operation is terminated and before a next image forming operation is started.

10 Claims, 15 Drawing Sheets

(51) Int. Cl.
*G03G 15/08* (2006.01)
*G03G 15/043* (2006.01)

(58) Field of Classification Search
CPC ..... B65H 2801/06; B65H 43/04; B41J 2/471; H04N 1/00015; H04N 1/00031; H04N 1/00042; H04N 1/00045; H04N 1/00047; H04N 1/0005; H04N 1/00063; H04N 1/00082; H04N 1/0009; H04N 1/4015; H04N 1/407
USPC ..... 399/345, 349; 358/3.02, 3.26, 521
See application file for complete search history.

(56) References Cited

U.S. PATENT DOCUMENTS 5,061,966 A * 10/1991 Haneda ..... G03G 15/0105 399/345
10,073,383 B2 * 9/2018 Kobayashi ..... G03G 15/161
2012/0275837 A1 * 11/2012 Ikari ..... G03G 21/0094 399/346
2013/0050388 A1 * 2/2013 Ohnishi ..... H04N 1/00015 347/224
2015/0009530 A1 * 1/2015 Soda ..... G06K 15/40 358/1.15
2016/0062253 A1 * 3/2016 Okada ..... G03G 5/04 430/56
2017/0068187 A1 * 3/2017 Ueno ..... G03G 21/105
2017/0097590 A1 * 4/2017 Kobayashi ..... G03G 15/161
2017/0160680 A1 * 6/2017 Oura ..... G03G 15/1615
2017/0300002 A1 * 10/2017 Imanaka ..... G03G 21/0005

FOREIGN PATENT DOCUMENTS

JP 2002-207354 A 7/2002
JP 2007-219238 A 8/2007
JP 2010-79300 A 4/2010
JP 2015-60101 A 3/2015

* cited by examiner

IMAGE FORMING APPARATUS

BACKGROUND OF THE INVENTION

Field of the Invention

The present invention relates to image forming apparatuses including a cleaner-less printer, a cleaner-less copier, and a cleaner-less facsimile.

Description of the Related Art (a) Cleaner-Less Process (Toner Recycle Process)

In recent years, image forming apparatuses have been miniaturized. However, if only individual units and individual devices for an image forming process including charging, exposing, developing, transferring, fixing, and cleaning are miniaturized, the miniaturization of entire image forming apparatuses has limitation. Furthermore, residual transfer toner (residual developer) on a photosensitive member after transfer becomes waste toner when being collected by a cleaning device (a cleaner), and the waste toner is not preferable in terms of environmental protection.

Therefore, an image forming apparatus having a configuration which is a so-called "cleaner-less process (cleaner-less method)" in which residual transfer toner on a photosensitive member is removed from the photosensitive member by "cleaning performed concurrently with development (development concurrent cleaning)" by a developing device and is collected by the developing device to be reused has been developed (Japanese Patent Laid-Open No. 8-137368). The development concurrent cleaning is a method for collecting toner which slightly remains on a photosensitive member after transfer at a time of development in a next process onwards in accordance with a potential difference (Vback) between a direct-current voltage to be applied to a developing device and a surface potential of the photosensitive member. According to this method, the residual transfer toner is used in the next process onwards after being collected by the developing device, and therefore, waste toner is not generated and simple maintenance is attained. Furthermore, this method has an advantage also in terms of a space since the image forming apparatus is cleaner-less, and therefore, a size of the image forming apparatus may be considerably reduced.

(b) Dust

Dust in the air and dust of fiber of cloths may become deposited on a sheet depending on a state of the sheet before printing. If printing is performed on a sheet having dust attached thereto, the dust may be attached to a photosensitive member. Image formation is further performed in the state in which the dust is attached to the photosensitive member, charging failure or developing failure occurs resulting in a defective image. When the charging failure occurs due to dust, an image defect which is referred to as "black spots" occurs in a non-image portion on the sheet, and when the developing failure occurs, an image defect which is referred to as "white spots" occurs in an image forming portion on the sheet. The black spots are generated such that the charging failure occurs in a dust-attached portion on a surface of the photosensitive material and toner is transferred from the developing apparatus on a non-imaging portion and appears as black dots on the sheet. On the other hand, the white spots are white blanks in an image generated when toner is not developed in a dust portion if dust is attached to an image exposure portion on a photosensitive member.

In image forming apparatuses having a cleaner, dust is collected by the cleaner. However, in the cleaner-less image forming apparatus, dust is required to be collected by a developing apparatus in addition to residual transfer toner. When the developing apparatus collects toner using a potential difference (Vback) as described above, in general, a charge apparatus charges residual transfer toner in a desired polarity so that collection using a potential difference is facilitated. However, unlike toner, dust has various shapes and various types of material, and a number of types of dust are difficult to be charged in a desired polarity. In this case, in the general development concurrent cleaning, dust may be difficult to be subjected to development collection when compared with toner, and therefore, an image defect including white spots or black spots may occur.

(c) Sequence of Dust Cleaning

As a method for suppress failure of the development collection of dust, bias to be applied to a charge roller is increased, for example. If a bias to be applied to the charge roller is increased, the dust is negatively charged with ease, and a surface potential of a photosensitive member is increased so that a potential difference Vback is increased and collection property of the developing apparatus may be enhanced.

However, if the surface potential of the photosensitive member is changed, a potential obtained after image exposure is also changed, and therefore, density change may occur and image quality may be lowered. Furthermore, if the potential difference Vback becomes large, "inversion fogging" becomes advanced. Here, the term "inversion fogging" is a phenomenon in which a potential difference between the surface potential of the photosensitive member and a potential of the developing apparatus becomes large, and therefore, toner is transferred from the developing apparatus to a portion of the photosensitive member which is not subjected to the image exposure. The toner which is subjected to the inversion fogging mainly has a positive polarity, and therefore, it is difficult that the toner is electrostatically transferred on a sheet. However, a portion of the toner is transferred on a sheet due to friction between the photosensitive member and the sheet, and accordingly, an image defect may occur.

In this way, it is difficult to change a bias applied to the charge roller during the development concurrent cleaning. However, a bias applied to the charge roller may be changed in a non-image-forming period, such as a period of post-rotation, since the change less affects an image. Therefore, a method for performing a cleaning sequence for increasing a bias applied to the charge roller in the post-rotation when compared with a bias in the image formation and performing the development collection on dust which has not been collected by the development concurrent cleaning has been generally used. When the cleaning sequence is performed, the dust which remains in the photosensitive member may be collected in the development, and an image defect including black spots or white spots may be suppressed.

However, the general cleaning sequence is performed separately from a normal printing operation, and therefore, a period of time until end of the printing is increased. In a case where the cleaning sequence is performed in the course of a print job, a period of time required before output of an image is long, and start of a next print job may delay even when the cleaning sequence is performed after the image output is terminated.

Furthermore, the image forming apparatus and cartridges rotate for a long period of time since the cleaning sequence is performed, and therefore, a life duration of the apparatus is reduced.

SUMMARY OF THE INVENTION

Accordingly, the present disclosure provides an image forming apparatus capable of performing the cleaning sequence so as to suppress occurrence of an image defect and delay of image output and a life duration of the apparatus.

According to an embodiment of the present disclosure, an image forming apparatus includes a developing unit which develops a toner image on a surface of a photosensitive member and which collects toner which remains on the surface of the photosensitive member after the developed toner image is transferred to a transfer member. The image forming apparatus includes a controller configured to determine whether a cleaning operation of cleaning the surface of the photosensitive member is to be performed after an image forming operation is performed or control a period of time in which the cleaning operation is performed in accordance with a measured downtime of the image forming apparatus which is a period of time after the image forming operation is terminated and before a next image forming operation is started.

Further features of the present invention will become apparent from the following description of exemplary embodiments with reference to the attached drawings.

BRIEF DESCRIPTION OF THE DRAWINGS

FIGS. 8A to 80 are timing charts of signals according to the fourth embodiment.

DESCRIPTION OF THE EMBODIMENTS

Hereinafter, preferred embodiments of the present disclosure will be described in detail with reference to the accompanying drawings. Note that sizes, materials, shapes, and relative arrangements of components described in embodiments below are to be appropriately changed in accordance with a configuration of an apparatus to which the present technique is applied and various conditions. Accordingly, the scope of the present disclosure is not limited to these unless otherwise particularly stated.

First Embodiment

Figure 1:
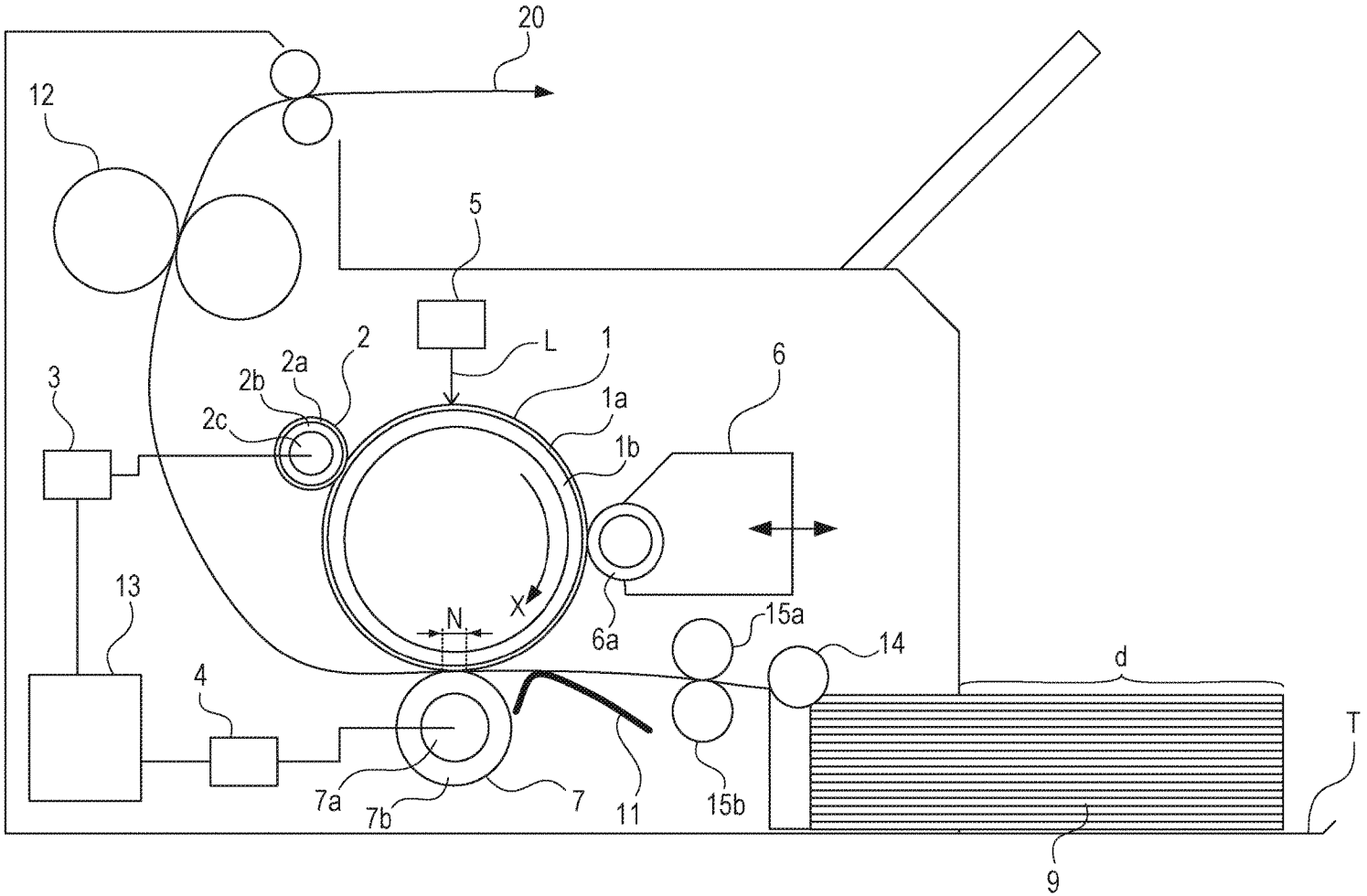
FIG. 1 is a sectional view of a main part of an image forming apparatus according to a first embodiment.

An image forming apparatus according to a first embodiment will be described with reference to FIG. 1. FIG. 1 is a cross sectional view schematically illustrating a configuration of an image forming apparatus according to the first embodiment.

Note that the image forming apparatus of this embodiment is a laser printer employing a transfer method utilizing an electrophotographic process. In this embodiment, a determination as to whether a cleaning sequence is to be performed in accordance with a downtime of the image forming apparatus is made. Note that the downtime of the image forming apparatus is a period of time measured by a control unit (a controller) described below, that is, a period of time from when a certain printing operation (an image forming operation) is terminated to when a next printing operation (an image forming operation) is started.

The image forming apparatus includes a photosensitive member 1 having a drum shape (hereinafter referred to as a "photosensitive drum") as an image bearing member. The photosensitive drum 1 includes a conductive base layer 1*b* formed of aluminum, iron, or the like and a photoconductive layer 1*a* formed of an organic photoconductive body, for example, disposed on an outer peripheral surface of the conductive base layer 1*b* as a base configuration layer and is driven to rotate in a direction indicated by an arrow mark X (a clockwise direction) in a certain circumferential velocity (a certain process speed). Note that the conductive base layer 1*b* is grounded.

The photosensitive drum 1 is uniformly subjected to a charge process so as to have a predetermined polarity and a predetermined potential (Vd) by a first charge apparatus (hereinafter referred to as a "charge roller") serving as a charger while the photosensitive drum 1 rotates. The charge roller 2 of this embodiment is a contact charge roller. The charge roller 2 includes a conductive roller 2*c*, such as a metallic roller serving as core metal, a conductive layer 2*b* formed on an outer peripheral surface of the conductive roller 2*c*, and a resistance layer 2*a* further formed on an outer peripheral surface of the conductive layer 2*b*. The charge roller 2 includes the conductive roller 2*c* having opposite ends supported by a bearing member (not illustrated) to be rotated, is disposed in parallel to the photosensitive drum 1, and is pressed toward the photosensitive drum 1 by a pressing unit, such as a spring not illustrated, with a predetermined pressing force so as to be in contact with the photosensitive drum 1. The charge roller 2 is rotated when the conductive roller 2*c* is forcibly driven by a driving unit, not illustrated.

Then a predetermined bias voltage (a direct current voltage or an oscillation voltage) is applied from a power source 3 through an electric contact to the conductive roller 2*c* so that a peripheral surface of the photosensitive drum 1 is uniformly subjected to the charge process in a contact charge method so as to have a predetermined polarity and a predetermined potential.

Subsequently, an image exposure unit 5, such as a laser scanner slit exposure unit, performs an image exposure process (an exposure L) using target image information on a surface of the photosensitive drum 1 to be subjected to the charge process so that electrostatic latent image of the target image information is formed on the surface of the photosensitive drum 1. Here, a potential of the exposed photosensitive drum 1 is denoted by "V1".

The electrostatic latent image is developed using a developing agent (toner) supported by a developing sleeve 6*a* of a developing apparatus (a developing unit) 6 as a thin layer so that a visible image (a toner image) is obtained. The toner image is supplied from a feeding unit side to a transfer portion N at a predetermined timing and is successively transferred to transfer members conveyed along a conveying path 20. A transfer roller (a transfer unit) 7 includes a conductive roller 7*a*, such as a metallic roller serving as a core metal, and a cylindrical conductive layer 7*b* formed on an outer peripheral surface of the conductive roller 7*a*. The transfer roller 7 includes the conductive roller 7*a* having opposite ends supported by a bearing member, not illustrated, in a rotatable manner, is arranged in parallel to the photosensitive drum 1, and is pressed toward the photosensitive drum 1 by a pressing unit, such as a spring not illustrated, so as to contact with the photosensitive drum 1. The transfer roller 7 rotates in accordance with rotation of the photosensitive drum 1. A contact nip portion between the photosensitive drum 1 and the transfer roller 7 corresponds to the transfer portion N.

A transfer member 9 is supplied from a sheet tray T using a feeding roller 14, conveyed by conveying rollers 15*a* and 15*b*, and supplied to the transfer portion N through a pre-transfer guide 11. When a leading edge of the transfer member 9 enters the transfer portion N, a power source 4 supplies a predetermined transfer bias voltage to the conductive roller 7*a*, a back surface of the transfer member 9 which is in contact with the transfer roller 7 is charged in a contact charge method so as to have a polarity opposite to that of the toner, and accordingly, a toner image on the photosensitive drum 1 is transferred on a surface of the transfer member 9.

The transfer member 9 having the toner image transferred thereto when the transfer member 9 passes the transfer portion N is separated from the surface of the photosensitive drum 1 before being supplied to an image fixing unit 12 where the transfer toner image is fixed on the transfer member 9 as a permanently-fixed image.

Little tonner which remains on the photosensitive drum 1 after the transfer member 9 passes the transfer portion (transfer nip) N is collected by the developing apparatus 6 using a potential difference (Vback) between the surface of the photosensitive drum 1 and the developing sleeve 6*a*. If the residual toner has reversed polarity, the toner may not be collected by the potential difference Vback, and therefore, the toner is required to be charged in a normal polarity by a charger. When the fixing of the image on the transfer member 9 is completed and the transfer member 9 is ejected out of the apparatus, the printing operation is terminated.

Note that, in the image forming apparatus of this embodiment, a period of time required for starting operation and finishing operation of the image forming apparatus is approximately 10 seconds, and a period of time required for image formation is approximately 10 seconds per one transfer member 9. Specifically, approximately 20 seconds is required for a print job for a single transfer member 9, and approximately 30 seconds is required for a print job for two transfer members 9.

A controller 13 performs operation control in the image forming process, and in addition, performs time counting, that is, the controller 13 may measure a downtime or the like. In this embodiment, the controller 13 serving as a control unit measures a downtime of the image forming apparatus.

In this embodiment, an example of a carrying member which has a carrying surface for carrying the transfer members 9 which is exposed out of the image forming apparatus is the sheet tray T. Therefore, when the transfer member 9 is set in the sheet tray T, a portion of the carrying surface for carrying the transfer members 9 (a region d in FIG. 1) is exposed out of the image forming apparatus and dust may be deposited on the exposed portion.

A life duration of the developing apparatus 6 is determined in accordance with a rotation time (a rotation speed) of the developing sleeve 6*a*, and a life duration of the developing sleeve 6*a* in this embodiment is approximately 40000 seconds. When this 40000 seconds is converted into the number of prints, approximately 2000 prints are obtained when a print job for one sheet is repeatedly performed and approximately 2650 prints are obtained when a print job for two sheets is repeatedly performed.

Relationship of Charge Polarities

In this embodiment, a toner is negatively charged in the developing apparatus 6. The charge roller 2 uniformly performs a charge process on the surface of the photosensitive drum 1 using a negative bias having a polarity the same as that of the toner, and the image exposure unit 5 performs image exposure. After the toner is developed by the developing apparatus 6 on an image exposure portion of the photosensitive drum 1, a positive bias having an opposite polarity is applied to the transfer portion N and a toner image is transferred from the photosensitive drum 1 to a sheet (the transfer member 9).

A voltage of −1000 V is applied to the charge roller 2, a voltage of −500 V is applied to the surface of the photosensitive drum 1, and laser exposure is performed so that the image exposure portion has a voltage of −150 V. Furthermore, the controller 13 causes the power source, not illustrated, to apply a voltage of −350 V to the developing apparatus 6, and a potential difference (Vback) between the developing sleeve 6*a* and the surface of the photosensitive drum 1 is 150 V.

Sequence of Dust Cleaning

In this embodiment, a cleaning sequence (a cleaning operation) for cleaning the surface of the photosensitive drum 1 performed by the developing apparatus 6 so that dust which is not collected to the development concurrent cleaning is collected is performed. In the cleaning sequence, the potential difference Vback is increased when compared with the development concurrent cleaning resulting in enhanced performance of development collection so that collection of dust is facilitated.

When the cleaning sequence is performed in this embodiment, a voltage of −1200 V is applied to the charge roller and a voltage of −700 V is charged to the surface of the photosensitive drum 1. Furthermore, a voltage of −350 V is applied to the developing apparatus. Therefore, the potential difference Vback at the time of the cleaning sequence is 350 V which is larger than that in the development concurrent cleaning.

Period of Time Required for Cleaning Sequence

In the development collection using the potential difference Vback, dust attached to a certain position of the photosensitive drum 1 is charged every rotation of the photosensitive drum 1 and subjected to the cleaning operation of the development collection. For example, if the dust may not be charged to a degree that the development collection is available in a first charge process, a charge amount is increased so that the development collection becomes available by repeatedly performing the charge process in second and third rotations and so on. Specifically, an effect of the cleaning sequence is changed depending on a period of time in which the cleaning sequence is performed. That is, the longer the period of time is, the higher the cleaning effect is.

In this embodiment, the photosensitive drum 1 has a diameter of 24 mm and is driven to rotate at a speed of 150 mm/sec in the direction denoted by the arrow mark X. Therefore, in the cleaning sequence, the cleaning is performed for approximately two rotations of the photosensitive drum 1 per one second. The cleaning sequence in this embodiment is performed for approximately 10.5 seconds. Note that a period of time required for rising and falling of a voltage of the charge roller and the developing apparatus 6 in the cleaning sequence is approximately 0.5 seconds, and the cleaning effect is obtained at maximum for approximately 10 seconds (20 rotations of the photosensitive drum 1).

Condition for Issuing Cleaning Sequence

In a case where the cleaning sequence is performed after a print job is terminated, if a next print job in a waiting state exists, for example, start of the next print job may delay by the period of time the cleaning sequence is performed. Furthermore, an operation time of the apparatus is increased by the period of time the cleaning sequence is performed, and therefore, a life duration of the apparatus may be disadvantageously reduced. Therefore, the cleaning sequence is not performed every after a print job is performed, but the cleaning sequence is preferably performed only when an image defect, such as white spots or black spots, is generated due to dust which has not been collected by the development concurrent cleaning. As described above, when an amount of dust deposited on the transfer member 9 is increased and an amount of dust attached to the photosensitive drum 1 is increased, a part of the dust may not be collected by the development collection. Specifically, a determination as to whether the cleaning sequence is to be performed is made depending on an amount of dust attached on the photosensitive drum 1.

Downtime and Dust Amount

This embodiment employs a method for estimating an amount of dust deposited on the transfer member 9 with reference to a downtime (a period of time between print jobs) of the image forming apparatus. For example, if a period of time from a time point when a certain printing operation is terminated to a time point when a next print job is started (the downtime) is long in a state in which the transfer member 9 is set on the sheet tray T, dust is deposited on the transfer member 9 (the region d in FIG. 1). Here, the amount of dust on the transfer member 9 is increased as the downtime is increased.

Therefore, in the image forming apparatus of this embodiment, the cleaning sequence is performed when the downtime is equal to or longer than a predetermined period of time (18 hours in this embodiment).

Operation of Cleaning Sequence

Next, an operation and functions of the image forming apparatus according to this embodiment will be described with reference to a flowchart of a printing operation illustrated in FIG. 2.

Figure 2:
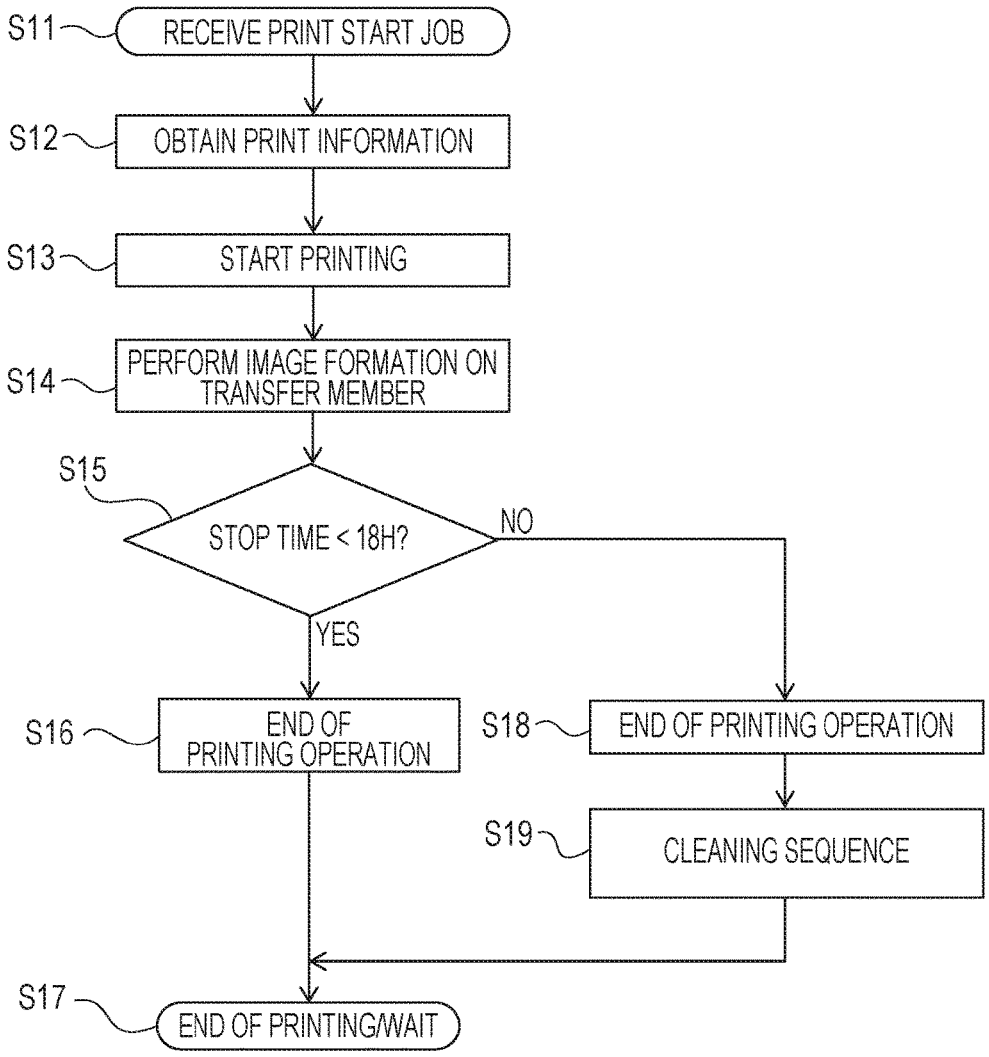
FIG. 2 is a flowchart of control according to the first embodiment.

As illustrated in FIG. 2, a user supplies a print start job to a printer (S11). Image size information as print information is supplied to the controller 13 of FIG. 1 (S12), the printer starts a print sequence (S13), and the printer performs image formation on the transfer member 9 (S14). The controller 13 checks a downtime after termination of a preceding printing operation (S15).

In a case where the downtime is shorter than 18 hours (shorter than the predetermined period of time), the printing operation is terminated (S16). In this case, although the printing is terminated, the cleaning sequence is not performed, and then, a waiting state is entered (S17). On the other hand, in a case where the downtime is equal to or longer than 18 hours (longer than the predetermined period of time), the printing operation is terminated (S18). Thereafter, the cleaning sequence is performed (S19). After the cleaning sequence is performed, the printing is terminated and the waiting state is entered (S17).

Check of Effects of Embodiment

An experiment of comparison between different image forming apparatuses which enter different downtimes is performed to check effects of this embodiment. Here, the image forming apparatuses enter different downtimes of 6 hours, 12 hours, 18 hours, 24 hours, and 48 hours.

First Experiment: Downtimes and Effects of Cleaning Sequence

As a checking method, an image defect is checked both in a case where the cleaning sequence is not performed in image forming apparatuses having the transfer member 9 on which dust is deposited during the predetermined downtimes and a case where the cleaning sequence of this embodiment is performed in the image forming apparatuses.

Conditions and Procedure

In the case where the cleaning sequence is not performed, the following conditions and a procedure are employed. 1. Dust exists (solid white): Dust is transferred to the photosensitive drum 1. 2. Dust does not exist (solid white): Generated black spots are counted. 3. Dust does not exist (HT): Generated white spots are counted.

In the case where the cleaning sequence is performed, the following conditions and a procedure are employed. 1. Dust exists (solid white): Dust is transferred to the photosensitive drum 1. 2. Cleaning Operation: Development collection is performed on the dust on the photosensitive drum 1. 3. Dust does not exist (solid white): Generated black spots are counted. 4. Dust does not exist (HT): Generated white spots are counted.

In a general office, an environment in which temperature is 23° C. and humidity is 50% is set, the transfer member 9 (LTR paper, grammage 75 g/m2) is left on the sheet tray T for a predetermined period of time, printing is performed in a state in which dust is deposited on the transfer member 9 (a solid white image), and the dust is transferred to the photosensitive drum 1. Subsequently, the solid white image is printed using a new transfer member 9 which does not have dust attached thereon and generated black spots are counted. Similarly, an HT image is printed after the left transfer member 9 is printed, and thereafter, generated white spots are counted.

Similarly, also in a case where the cleaning sequence is performed after the transfer member 9 having dust attached thereto (the left transfer member 9) is printed, black spots or white spots generated in a next printing operation are counted.

A result of the first experiment is illustrated in Table 1. Table 1 illustrates sums of the numbers of generated black spots and white spots under the various conditions.

TABLE 1

| THE NUMBER OF GENERATED WHITE SPOTS OR BLACK SPOTS | THE NUMBER OF IMAGE DEFECTS OBTAINED WHEN PRINTING IS PERFORMED AFTER DOWNTIME | | | | |
|---|---|---|---|---|---|
| | 6 H | 12 H | 18 H | 24 H | 48 H |
| NO CLEANING SEQUENCE | 0 | 0 | 0 | 1 | 3 |
| WITH CLEANING SEQUENCE OF THIS EMBODIMENT | 0 | 0 | 0 | 0 | 0 |

As illustrated in Table 1, in the case where the cleaning sequence is not performed, if a downtime is equal to or larger than 24 hours, an image defect occurs. On the other hand, in the case where the cleaning sequence of this embodiment is performed, an image defect does not occur even when a downtime is 48 hours. Therefore, it is preferable that the cleaning sequence is not performed when the downtime is shorter than 18 hours (shorter than the predetermined period of time) in this embodiment and the cleaning sequence is performed when the downtime is equal to or longer than 18 hours.

Second Experiment: Condition for Cleaning Sequence and Apparatus Life Duration

Next, the number of sheets which are printable by development life duration in a case where the cleaning sequence is performed for each print job, which is a comparison example, and the number of sheets which are printable by the development life duration in a case where the cleaning sequence is performed when the downtime of this embodiment becomes equal to or longer than 18 hours are compared with each other.

Condition

It is assumed that a print job for consecutively printing two sheets is performed four times a day.

Under this condition, in the case where the cleaning sequence is performed when the downtime of this embodiment is equal to or longer than 18 hours, the cleaning sequence is performed only for a first print job in a day at most. It is assume that the cleaning sequence is performed by all means when a first print job for a day is performed in this embodiment.

A result of the second experiment is illustrated in Table 2.

TABLE 2

| | ROTATION TIME OF DEVELOPING SLEEVE OBTAINED WHEN JOB FOR 2 PRINTS IS PERFORMED 4 TIMES A DAY | | | THE NUMBER OF PRINTABLE SHEETS BY DEVELOPMENT LIFE DURATION |
|---|---|---|---|---|
| | PRINT OPERATION | CLEANING OPERATION | SUM | |
| CLEANING SEQUENCE IS PERFORMED FOR EACH PRINT JOB (COMPARATIVE EXAMPLE) | 120 SEC | 42 SEC (4 TIMES) | 162 SEC | 1974 SHEETS |
| CONDITION FOR CLEANING SEQUENCE OF THIS EMBODIMENT (DOWNTIME IS NOT LESS THAN 18 HOURS) | 120 SEC | 10.5 SEC (ONCE) | 130.5 SEC | 2448 SHEETS |

As illustrated in Table 2, a cleaning operation time of this embodiment is shorter than a cleaning operation time obtained in the case where the cleaning sequence is performed for each print job which is the comparative example. Therefore, the number of sheets which are printable by the time when 40000 seconds which is the life duration (a rotation time) of the developing sleeve 6*a* is reached is larger than the comparative example. Specifically, 1974 sheets are printable in the comparative example, whereas 2448 sheets are printable in this embodiment.

Summary of Effects in First Embodiment

As described above, since the cleaning sequence is performed where appropriate in accordance with the downtime (an amount of dust), an optimum rotation speed of the developing sleeve 6*a* may be attained. By this, decrease of the life duration of the apparatus and delay of a next print job may be suppressed while occurrence of an image defect is suppressed.

Note that, although a period of time the cleaning is performed is 10.5 seconds in the cleaning sequence of this embodiment, the present technique is not limited to this and the period of time the cleaning is performed may be changed depending on a use condition of the image forming apparatus.

Second Embodiment

An image forming apparatus of a second embodiment will be described. Note that components which are not described in the following description are the same as those of the first embodiment described above, and therefore, descriptions thereof are omitted.

Although a determination as to whether the cleaning sequence is to be performed is made depending on the downtime (the amount of dust) in the first embodiment, a period of time a cleaning sequence (a cleaning operation) is performed is changed in accordance with a downtime in this embodiment.

In the first embodiment, the verification is made until the case where the downtime is 48 hours. However, if the downtime becomes longer, an amount of dust on a transfer member 9 is further increased, and therefore, occurrence of an image defect may not be suppressed even if the cleaning sequence of the first embodiment is performed. In this case, dust collection performance is improved by extending a period of time the cleaning sequence is performed, so that occurrence of an image defect is suppressed. As the period of time the cleaning sequence is performed is longer, a dust collection effect is higher. However, the period of time the cleaning sequence is to be performed is preferably determined in accordance with an amount of dust in terms of a life duration of the apparatus and delay of a next print job.

To verify the effect of this embodiment, a determination as to whether an image defect occurs in a case where printing is performed after a predetermined downtime is made, and in addition, a period of time the cleaning sequence is performed to suppress occurrence of an image defect is checked.

Cleaning Sequence

As described above, a cleaning effect may be enhanced by increasing the period of time the cleaning sequence is performed.

In this embodiment, one of two cleaning sequences, that is, the cleaning sequence performed in a first performance time (approximately 10.5 seconds in the first embodiment) and a cleaning sequence performed in a second performance time (approximately 20.5 seconds) is selectively used in accordance with a downtime. Note that a period of time required for rising and falling of a voltage of a charge roller 2 and a developing apparatus 6 in the cleaning sequence is approximately 0.5 seconds, and the cleaning effect is obtained at maximum for approximately 10 seconds (for 20 rotations of the photosensitive drum 1) in a case where the cleaning sequence is performed for 10.5 seconds.

Operation of Cleaning Sequence

Next, an operation and functions of the image forming apparatus according to this embodiment will be described with reference to a flowchart of a printing operation illustrated in FIG. 3.

Figure 3:
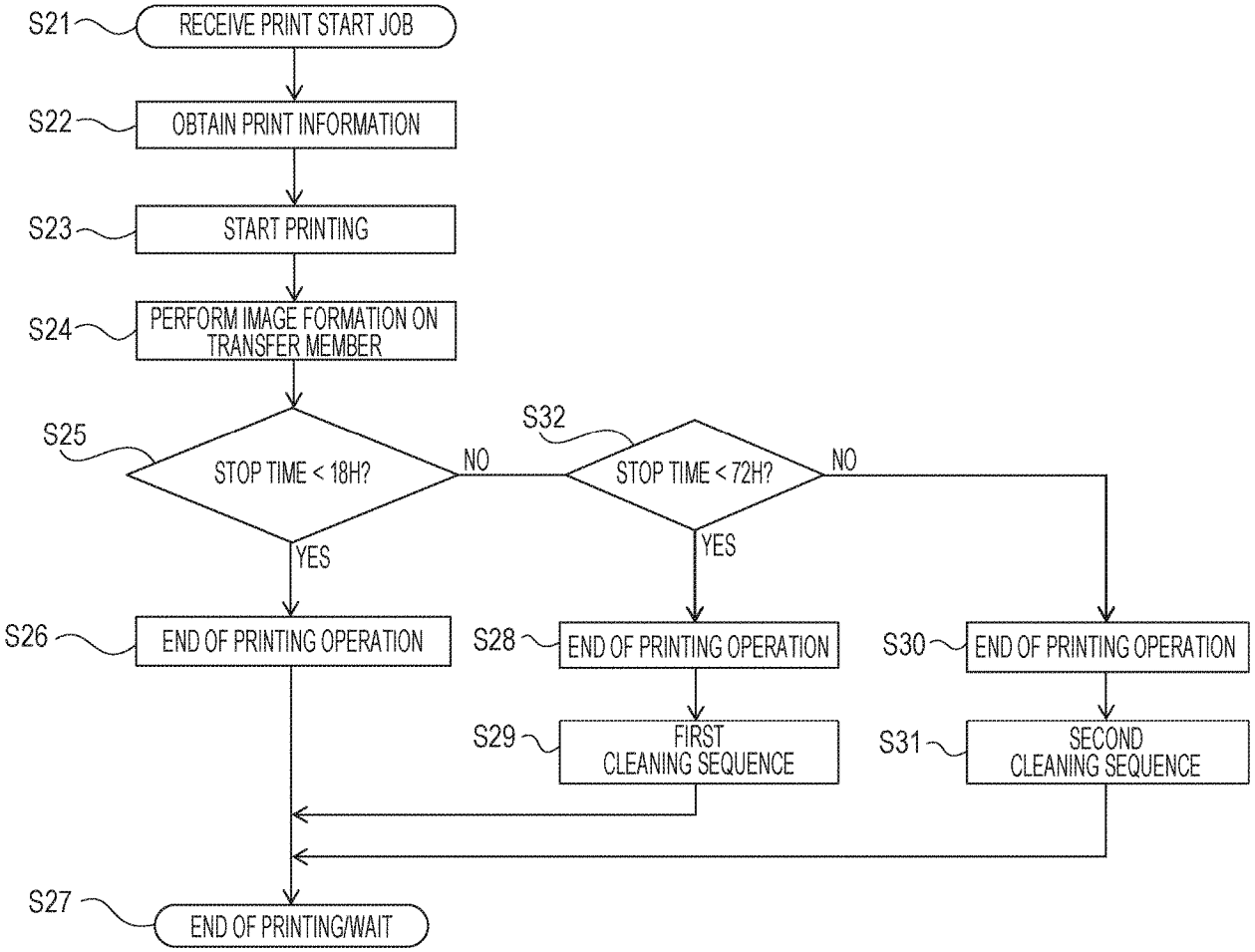
FIG. 3 is a flowchart of control according to a second embodiment.

As illustrated in FIG. 3, a user supplies a print start job to a printer (S21). Image size information as print information is supplied to a controller 13 of FIG. 1 (S22), the printer starts a print sequence (S23), and the printer performs image formation on the transfer member 9 (S24). The controller 13 checks a downtime after termination of a preceding printing operation (S25).

In a case where the downtime is shorter than 18 hours, the printing operation is terminated (S26). In this case, although the printing is terminated, the cleaning sequence is not performed, and thereafter, a waiting state is entered (S27). On the other hand, when the downtime is equal to or longer than 18 hours and shorter than 72 hours, the printing operation is terminated (S28) and the first cleaning sequence is performed (S29). In the first cleaning sequence, the cleaning sequence of the first performance time is performed. Then the printing is terminated and a waiting state is entered (S27). Furthermore, when the downtime is equal to or longer than 72 hours, the printing operation is terminated (S30) and the second cleaning sequence is performed (S31). In the second cleaning sequence, the cleaning sequence of the second performance time which is longer than the first performance time is performed. Then the printing is terminated and a waiting state is entered (S27).

Although the first predetermined time is 18 hours and the second predetermined time is 72 hours which is longer than the first predetermined time which are to be compared with a downtime in this embodiment, the present technique is not limited to this. The predetermined time to be compared with a downtime is to be appropriately set for each apparatus in accordance with an amount of dust deposited on a left recording member or the like.

Check of Effects of Embodiment

An experiment of comparison between different image forming apparatuses which enter the different downtimes is performed to check effects of this embodiment. Here, the image forming apparatuses enter different downtimes of 6 hours, 12 hours, 18 hours, 24 hours, 48 hours, 72 hours, and 120 hours.

Third Experiment: Downtimes and Cleaning Sequence Performance Times

As a checking method, presence and absence of an image defect is checked in a case where the cleaning sequence is not performed on image forming apparatuses having the transfer member 9 on which dust is deposited during the predetermined downtimes, a case where the cleaning sequence of the first performance time (10.5 seconds here) is performed, and a case where the cleaning sequence of the second performance time (20.5 seconds here) is performed.

Conditions and Procedure

In a general office, an environment in which temperature is 23° C. and humidity is 50% is set, the transfer member 9 (LTR paper, grammage 75 g/m2) is left on the sheet tray T for a predetermined period of time, printing is performed in a state in which dust is deposited on the transfer member 9 (a solid white image), and the dust is transferred to the photosensitive drum 1. Subsequently, the solid white image is printed on a new transfer member 9 which does not have dust attached thereon and generated black spots are counted. Similarly, an HT image is printed after the left transfer member 9 is printed, and thereafter, generated white spots are counted.

Similarly, also in a case where the cleaning sequence is performed for 10.5 seconds after the transfer member 9 having dust attached thereto (the left transfer member 9) is printed and a case where the cleaning sequence is performed for 20.5 seconds after the transfer member 9 having dust attached thereto (the left transfer member 9) is printed, generated black spots and generated white spots are counted in a next printing operation.

A result of the third experiment is illustrated in Table 3. Table 3 illustrates sums of generated black spots and white spots under the various conditions.

TABLE 3

| THE NUMBER OF GENERATED WHITE SPOTS AND BLACK SPOTS | THE NUMBER OF IMAGE DEFECTS IN PRINTING AFTER DOWNTIME | | | | | | |
|---|---|---|---|---|---|---|---|
| | 6 H | 12 H | 18 H | 24 H | 48 H | 72 H | 120 H |
| NO CLEANING SEQUENCE | 0 | 0 | 0 | 1 | 3 | 5 | 8 |
| CLEANING SEQUENCE FOR 10.5 SEC | 0 | 0 | 0 | 0 | 0 | 1 | 2 |
| CLEANING SEQUENCE FOR 20.5 SEC | 0 | 0 | 0 | 0 | 0 | 0 | 0 |

As illustrated in Table 3, in the case where the cleaning sequence is not performed, when a downtime is equal to or longer than 24 hours, an image defect occurs. Furthermore, in the case where the cleaning sequence is performed for 10.5 seconds, when the downtime is equal to or longer than 72 hours, an image defect occurs. On the other hand, in the case where the cleaning sequence is performed for 20.5 seconds, an image defect does not occur even when a downtime is 120 hours. Accordingly, it is preferable that the cleaning sequence is performed for 10.5 seconds (the first performance time) when the downtime is equal to or longer than 18 hours and shorter than 48 hours, whereas the cleaning sequence is performed for 20.5 seconds (the second performance time) when the downtime is equal to or longer than 48 hours and shorter than 120 hours.

Fourth Experiment: Condition for Cleaning Sequence and Life Duration of Apparatus Next, the number of sheets which are printable by a development life duration in a case where the cleaning sequence is performed for each print job, which is a comparison example, and the number of sheets which are printable by the development life duration in a case where the cleaning sequence is performed for 10. 5 seconds when the downtime of this embodiment is equal to or longer than 18 hours and shorter than 48 hours and the cleaning sequence is performed for 20.5 seconds when the downtime is equal to or longer than 48 hours and shorter than 120 hours are compared with each other.

Condition

It is assumed that a print job for consecutively printing two sheets is performed four times a day, and printing is not performed on Saturday and Sunday in a week.

Under this condition, since it is expected that a downtime is equal to or longer than 48 hours in first printing on Monday, the cleaning sequence is performed for 20.5 seconds. Furthermore, it is expected that a downtime becomes equal to or longer than 18 hours only once at most, that is, in a first print job, in a day on Tuesday, Wednesday, Thursday, and Friday. In this embodiment, the cleaning sequence is performed for 10.5 seconds when the first print job in a day is performed on Tuesday, Wednesday, Thursday, and Friday.

A result of the fourth experiment is illustrated in Table 4.

TABLE 4

| | ROTATION TIME OF DEVELOPING SLEEVE IN ONE WEEK WHEN PRINT JOB FOR TWO SHEETS IS PERFORMED FOUR TIME A DAY | | | THE NUMBER OF SHEETS PRINTABLE BY |
|---|---|---|---|---|
| | PRINTING OPERATION | CLEANING OPERATION | SUM | DEVELOPMENT LIFE DURATION |
| CLEANING SEQUENCE IS PERFORMED FOR EACH PRINT JOB (COMPARATIVE EXAMPLE) | 600 SEC | 410 SEC (20.5 SEC × 20) | 1010 SEC | 1584 SHEETS |
| CONDITION FOR CLEANING SEQUENCE OF THIS EMBODIMENT | 600 SEC | 62.5 SEC (20.5 × 1 + 10.5 × 4) | 662.5 SEC | 2400 SHEETS |

As illustrated in Table 4, a cleaning operation time of this embodiment is shorter than a cleaning operation time obtained in the case where the cleaning sequence is performed for each print job which is the comparative example. Therefore, the number of sheets which are printable by the time when 40000 seconds which is life duration (a rotation time) of a developing sleeve 6*a* is reached is larger than the comparative example. Specifically, 1584 sheets are printable in the comparative example, whereas 2400 sheets are printable in this embodiment.

Summary of Effect of Second Embodiment

As described above, the cleaning sequence is performed at an appropriate timing for an appropriate period of time in accordance with a downtime (an amount of dust) so that an optimum rotation speed of the developing sleeve 6*a* is attained. By this, decrease of the life duration of the apparatus and delay of a next print job may be suppressed while occurrence of an image defect is suppressed.

Note that, although a period of time the cleaning is performed is 10.5 seconds or 20.5 seconds in the cleaning sequence of this embodiment, the present technique is not limited to this and the period of time the cleaning is performed may be changed depending on a use condition of the image forming apparatus. For example, when a downtime is longer than 120 hours which is included in effect verification in this embodiment or when the apparatus is used under an environment in which an amount of dust deposited on the transfer member 9 is large, occurrence of an image defect may be further suppressed by a longer performance time of the cleaning sequence.

Third Embodiment

An image forming apparatus of a third embodiment will be described. Note that components which are not described in the following description are the same as those of the first embodiment described above, and therefore, descriptions thereof are omitted.

Figure 4:
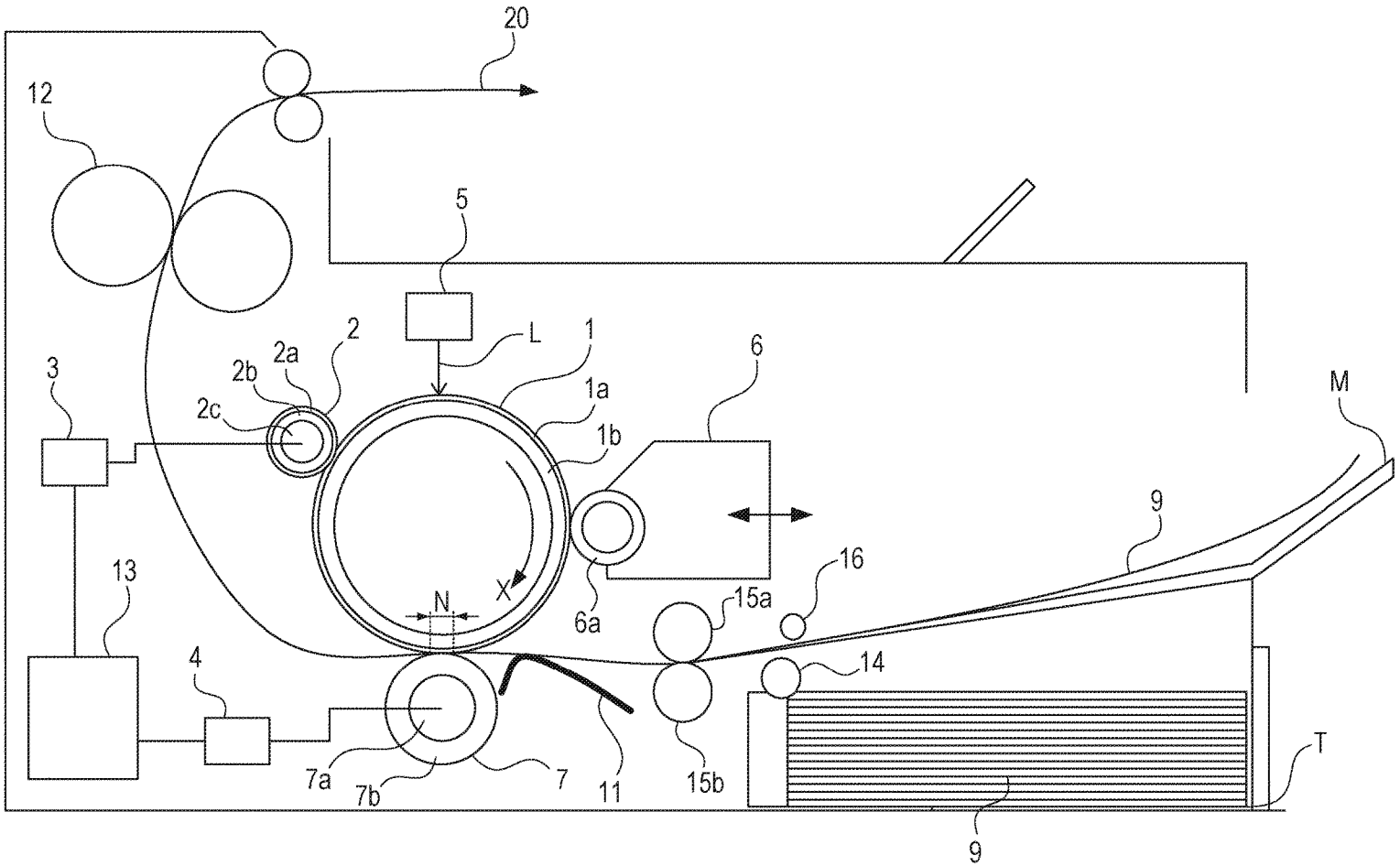
FIG. 4 is a sectional view of a main part of an image forming apparatus according to a third embodiment.

The image forming apparatus according to the third embodiment will be described with reference to FIG. 4. FIG. 4 is a cross sectional view schematically illustrating a configuration of the image forming apparatus according to the third embodiment.

The image forming apparatus of this embodiment includes a plurality of carrying members which carry transfer members 9. Here, a sheet tray T is illustrated as a first carrying member and a multi-size tray M is illustrated as a second carrying member.

In the image forming apparatus according to this embodiment, the transfer members 9 are accommodated in the image forming apparatus when being set on the sheet tray T, and therefore, dust is barely deposited on the transfer members 9. However, a size of the transfer members 9 which are settable in the sheet tray T is restricted, and transfer members 9 of sizes larger the sheet tray T are not accommodated in the image forming apparatus. Therefore, the multi-size tray M is used for transfer members 9 of a large size. In the image forming apparatus of this embodiment, the sheet tray T is used for sheets of an A4 size and an LTR size, and the multi-size tray M is used for larger transfer members 9.

When the transfer member 9 is supplied from the multi-size tray M, a feeding roller 16 is used. Thereafter the transfer member 9 is conveyed by conveying rollers 15*a* and 15*b*, and a subsequent process is the same as that performed when the sheet tray T is used. A determination as to whether the sheet tray T or the multi-size tray M is used for sheet feeding is made under control of a controller 13 in accordance with a user's instruction. The controller 13 performs operation control in the image forming process, and in addition, performs time counting, and therefore, the controller 13 may measure a feeding time or the like.

When the transfer member 9 is set on the multi-size tray M, a portion of the transfer member 9 may be exposed out of the image forming apparatus. In this case, dust is deposited on the portion. If printing is performed while dust is attached on the transfer member 9, the dust may be attached on a photosensitive drum 1. If image formation is performed in a state in which dust is attached on the photosensitive drum 1, charging failure or developing failure may occur resulting in an image defect.

Therefore, in this embodiment, a cleaning sequence is performed when the multi-size tray M having a carrying surface for transfer members which is exposed out of the apparatus is used so that occurrence of an image defect is suppressed.

As a condition for an operation of the cleaning sequence, when an interval of sheet feeding from the multi-size tray M exceeds a predetermined period of time, the cleaning sequence is performed after a next printing operation. Content of the operation of the cleaning sequence is the same as those described in the first and second embodiments. Note that the interval of sheet feeding from the multi-size tray M corresponds to a period of time from when a certain feeding operation is terminated to when a next feeding operation is performed. Although the method for estimating an amount of dust deposited on the transfer member 9 in accordance with a downtime (a period of time between print jobs) of the image forming apparatus is employed in the first and second embodiments described above, a method for estimating an amount of dust in accordance with an interval of sheet feeding from the multi-size tray M is employed in this embodiment.

As described above, even in a case where a plurality of feeding ports (trays) are employed, one of the feeding ports to be subjected to the cleaning sequence is selected in accordance with a sheet feeding interval (an amount of dust). In this way, decrease of life duration of the apparatus and delay of a next print job may be suppressed while occurrence of an image defect is suppressed.

Operation of Cleaning Sequence

Next, an operation and functions of the image forming apparatus according to this embodiment will be described with reference to a flowchart of a printing operation illustrated in FIG. 5.

Figure 5:
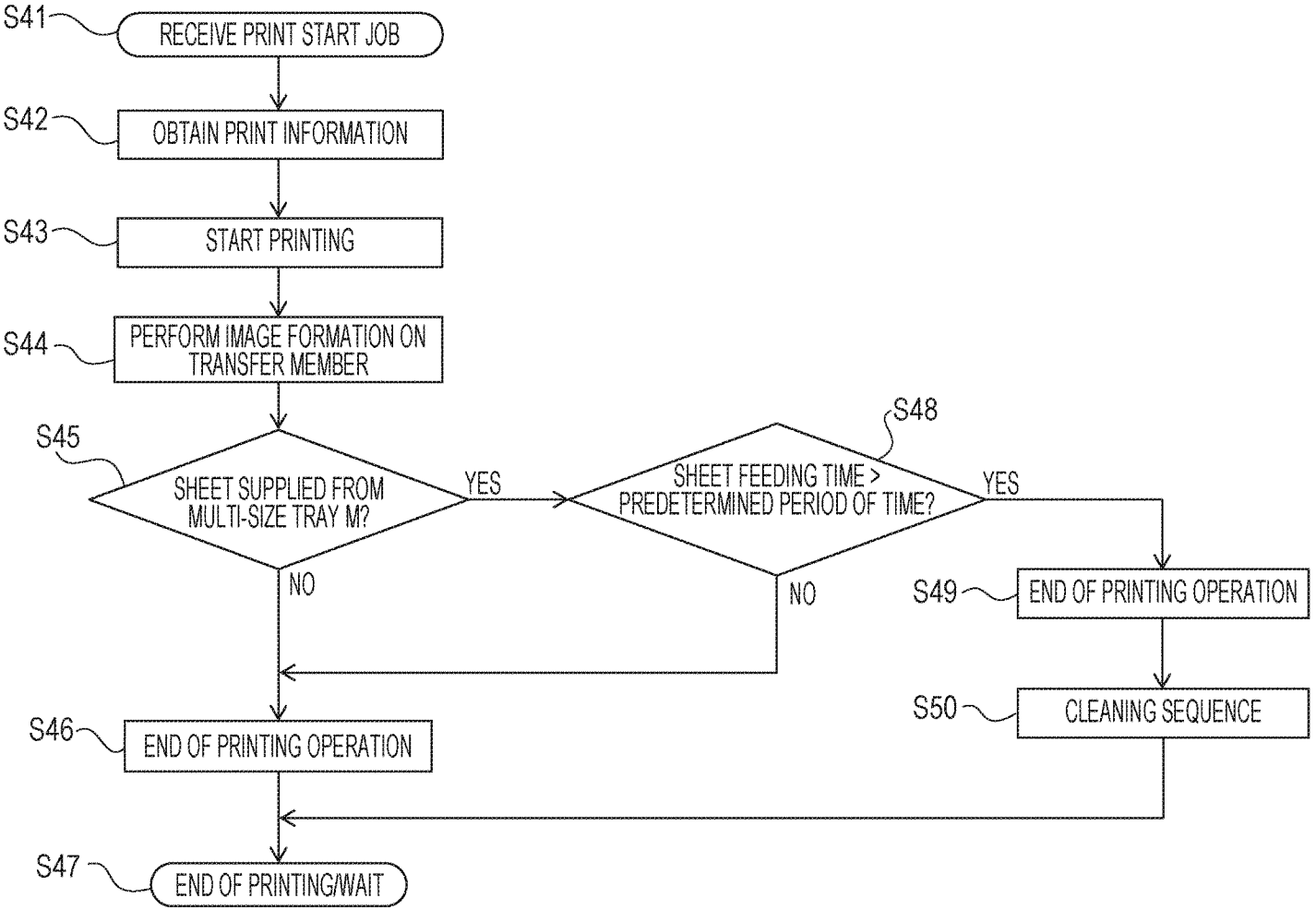
FIG. 5 is a flowchart of control according to the third embodiment.

As illustrated in FIG. 5, a user supplies a print start job to a printer (S41). Image size information as print information is supplied to the controller 13 of FIG. 1 (S42), the printer starts a print sequence (S43), and the printer performs image formation on the transfer member 9 (S44). Here, the controller 13 determines one of the sheet tray T and the multi-size tray M which has supplied the transfer member 9 (S45). When the transfer member 9 is supplied from the sheet tray T, the printing operation is terminated (S46). In this case, although the printing is terminated, the cleaning sequence is not performed, and a waiting state is entered (S47).

On the other hand, the transfer member 9 is supplied from the multi-size tray M, the controller 13 determines whether a feeding time (a feeding interval or a downtime) exceeds a predetermined period of time (S48). When the determination is negative, the printing operation is terminated (S46). In this case, although the printing is terminated, the cleaning sequence is not performed, and a waiting state is entered (S47). On the other hand, when the determination is affirmative, the printing operation is terminated (S49). Thereafter, the cleaning sequence is performed (S50). After the cleaning sequence is performed, the printing is terminated and the waiting state is entered (S47).

As described above, when the transfer member 9 is supplied from the multi-size tray M, the cleaning sequence is performed where appropriate in accordance with the feeding time (the amount of dust). By this, decrease of the life duration of the apparatus and delay of a next print job may be suppressed while occurrence of an image defect is suppressed.

Note that, as with the second embodiment described above, a performance time of the cleaning sequence (the cleaning operation) may be changed in accordance with a feeding time (an interval of sheet feeding) from the multi-size tray M also in this embodiment. Also with this configuration, the same effects as the foregoing embodiments may be obtained.

Fourth Embodiment

Figure 6:
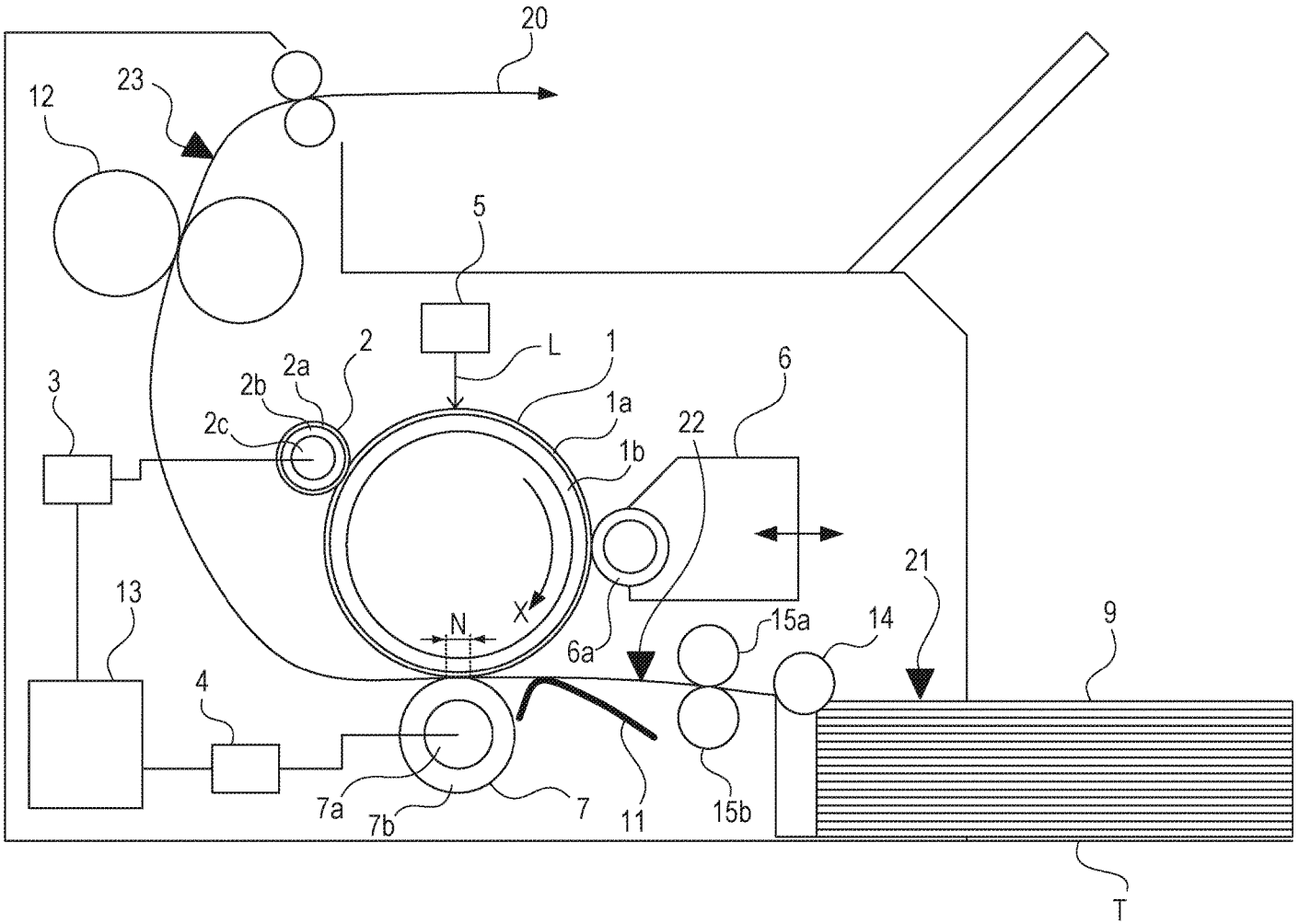
FIG. 6 is a sectional view of a main part of an image forming apparatus according to fourth and sixth embodiments.

An image forming apparatus according to a fourth embodiment will be described with reference to FIG. 6. FIG. 6 is a cross sectional view schematically illustrating a configuration the image forming apparatus according to the fourth embodiment.

Note that the image forming apparatus of this embodiment is a laser printer employing a transfer method utilizing an electrophotographic process.

The image forming apparatus includes a photosensitive member (photosensitive drum) 1 having a drum shape as an image bearing member. The photosensitive drum 1 includes a conductive base layer 1*b* formed of aluminum, iron, or the like and a photoconductive layer 1*a* formed of an organic photoconductive body, for example, disposed on an outer peripheral surface of the conductive base layer 1*b* as a base configuration layer and is driven to rotate in a direction indicated by an arrow mark X (a clockwise direction) in a certain circumferential velocity (a process speed). Note that the conductive base layer 1*b* is grounded.

The photosensitive drum 1 is uniformly subjected to a charge process performed by a first charge apparatus (charge roller) 2 serving as a charger so as to have a predetermined polarity and a predetermined potential (Vd) while the photosensitive drum 1 rotates. The charge roller 2 of this embodiment is a contact charge roller. The charge roller 2 includes a conductive roller 2*c*, such as a metallic roller serving as core metal, a conductive layer 2*b* formed on an outer peripheral surface of the conductive roller 2*c*, and a resistance layer 2*a* further formed on an outer peripheral surface of the conductive layer 2*b*. The charge roller 2 includes the conductive roller 2*c* having opposite ends supported by a bearing member (not illustrated) to be rotated, is disposed in parallel to the photosensitive drum 1, and is pressed toward the photosensitive drum 1 by a pressing unit, such as a spring not illustrated, with a predetermined pressing force so as to be in contact with the photosensitive drum 1. The charge roller 2 is rotated when the conductive roller 2*c* is forcibly driven by a driving unit, not illustrated.

Then a predetermined bias voltage (a direct current voltage or an oscillation voltage) is applied from a power source 3 through an electric contact to the conductive roller 2*c* so that a peripheral surface of the photosensitive member 1 is uniformly subjected to the charge process in a contact charge method so as to have a predetermined polarity and a predetermined potential.

Subsequently, an image exposure unit 5, such as a laser scanner slit exposure unit, performs an image exposure process (an exposure L) using target image information on a surface of the photosensitive drum 1 to be subjected to the charge process so that an electrostatic latent image of the target image information is formed on the surface of the photosensitive drum 1. Here, a potential of the exposed photosensitive member 1 is denoted by "V1".

The electrostatic latent image is developed using a developing agent (toner) supported by a developing sleeve 6*a* of a developing apparatus (a developing unit) 6 as a thin layer so that a visible image (a toner image) is obtained. The toner image is supplied from a feeding unit side to a transfer portion N at a predetermined timing and is successively transferred to transfer members conveyed along a conveying path 20. A transfer roller (a transfer unit) 7 of this embodiment serving as a contact charge transfer roller includes a conductive roller 7*a*, such as a metallic roller serving as a core metal, and a cylindrical conductive layer 7*b* formed on an outer peripheral surface of the conductive roller 7*a*. The transfer roller 7 includes the conductive roller 7*a* having opposite ends supported by a bearing member, not illustrated, in a rotatable manner, is arranged in parallel to the photosensitive drum 1, and is pressed toward the photosensitive drum 1 by a pressing unit, such as a spring not illustrated, so as to contact with the photosensitive drum 1. The transfer roller 7 rotates in accordance with rotation of the photosensitive drum 1. A contact nip portion between the photosensitive member 1 and the transfer roller 7 corresponds to the transfer portion N.

A transfer member 9 is supplied from a sheet tray T using a feeding roller 14, conveyed by conveying rollers 15*a* and 15*b*, and supplied to the transfer portion N through a pre-transfer guide 11. When a leading edge of the transfer member 9 enters the transfer portion N, a power source 4 supplies a predetermined transfer bias voltage to the conductive roller 7*a*, a back surface of a transfer member which is in contact with the transfer roller 7 is charged in a contact charge method so as to have a polarity opposite to that of the toner, and accordingly, a toner image on the photosensitive drum 1 is transferred on a surface of the transfer member 9.

The transfer member 9 having the toner image transferred thereto when the transfer member 9 passes the transfer portion N is separated from the surface of the photosensitive member 1 before being supplied to an image fixing unit 12, and the transfer toner image is fixed on the transfer member 9 as permanently-fixed image.

Little tonner which remains on the photosensitive member 1 after the transfer member 9 passes the transfer portion (transfer nip) N is collected by a developing apparatus 6 using a potential difference (Vback) between the surface of the photosensitive member 1 and a developing sleeve 6*a*. If the residual toner has reversed polarity, the toner may not be collected by the potential difference Vback, and therefore, the toner is required to be charged in a normal polarity by a charger. When the fixing of the image on the transfer member 9 is completed and the transfer member 9 is ejected out of the apparatus, the printing operation is terminated.

In the image forming apparatus of this embodiment, approximately 15 seconds is required for a period of time from start of printing to end of printing. Furthermore, the controller 13 performs operation control in the image forming process described above.

Hereinafter, settings of high voltages in this embodiment will be described in detail. In this embodiment, toner is negatively charged in the developing apparatus 6. The charge roller 2 uniformly performs a charge process on the surface of the photosensitive drum 1 using a negative bias having a polarity the same as that of the toner. After the toner is developed by the developing apparatus 6 on the image exposure portion of the photosensitive member 1, a positive bias having an opposite polarity is applied to the transfer portion N and a toner image is transferred from the photosensitive drum 1 to a sheet (the transfer member 9).

A voltage of −1000 V is applied to the charge roller 2, a voltage of −500 V is applied to the surface of the photosensitive drum 1, and laser exposure is performed so that the image exposure portion performs has a voltage of −150 V. Furthermore, the controller 13 causes the power source, not illustrated, to apply a voltage of −350 V on the developing apparatus 6, and a potential difference (Vback) between the developing sleeve 6*a* and the photosensitive drum 1 is 150 V.

Residual transfer toner is charged by the charge roller 2 to have a negative polarity and collected by the developing apparatus 6 from the photosensitive drum 1 by the potential difference Vback.

Hereinafter, a mechanism of occurrence of an image defect caused by dust attached on the photosensitive drum 1 will be described. Most of the dust is attached on the photosensitive drum 1 such that dust in the air is deposited on the uppermost transfer member 9 while the transfer member 9 is placed on the sheet tray T and is transferred on the drum 1 during a printing operation.

In this case, most of the dust attached on the photosensitive drum 1 is also charged by the charge roller 2, as with the residual transfer toner, to have a negative polarity and is collected by the developing apparatus 6. However, the dust may not be collected if a size, a shape, or material of the dust is not sufficient for the negative charging or if a charge amount is small. In this case, developing failure or charging failure occurs in the portion on the photosensitive drum 1 to which the dust is attached resulting in an image defect.

As a method for reducing failure of development collection of dust, a bias to be applied to the charge roller 2 is increased, for example. If a bias to be applied to the charge roller 2 is increased, the dust is negatively charged with ease, and a surface potential of the photosensitive drum 1 is increased so that a potential difference Vback is increased and collection property of the developing apparatus may be improved.

However, if the surface potential of the photosensitive drum 1 is changed, a potential obtained after image exposure is also changed, and therefore, density change may occur and affect image quality. Furthermore, if the potential difference Vback is large, "inversion fogging" may become advanced. Here, the term "inversion fogging" is a phenomenon in which a polarity of toner which has been negatively charged by the developing apparatus 6 is reversed due to a potential difference between the surface potential of the photosensitive drum 1 and a potential of the developing apparatus 6, that is, the toner has a positive polarity, and therefore, the toner is transferred from the developing apparatus 6 to a portion of the photosensitive drum 1 which is not subjected to the image exposure. The toner which is subjected to the inversion fogging has the positive polarity, and therefore, the toner is not electrostatically transferred on the transfer member 9. However, a part of the toner is transferred on the transfer member 9, and accordingly, image defect may occur.

When the developing failure occurs due to dust, an image defect which is referred to as "white spots" is generated in an image forming portion on the transfer member 9, and when the charging failure occurs, an image defect which is referred to as "black spots" is generated in a non-image portion on the transfer member 9.

The white spots are white blanks in an image to be black generated when toner is not developed in a dust portion if dust is attached to an image exposure portion on the photosensitive drum 1. On the other hand, the black spots are generated when the charging failure occurs in a dust attachment portion on a surface of the photosensitive drum 1, a potential of the portion becomes higher than that of the developing apparatus, and accordingly, toner is transferred from the developing apparatus 6 even in a non-image portion and appears as black spots on the transfer member 9.

As described above, it is difficult to change a bias to be applied to the charge roller 2 during the development concurrent cleaning. However, a bias to be applied to the charge roller may be changed in a non-image-forming period, since the change less affects an image in the non-image-forming period. Therefore, a cleaning sequence (a cleaning operation) for increasing a bias to be applied to the charge roller 2 in the non-image formation when compared with a bias in the image formation so as to perform development collection on dust which has not been collected by the development concurrent cleaning is performed. When the cleaning sequence is performed, the development collection may be performed on the dust which remains in the photosensitive drum 1 and an image defect including black spots and white spots may be suppressed.

In the cleaning sequence is performed in this embodiment, a voltage of −1200 V is applied to the charge roller 2, a voltage of −700 V is charged to the surface of the photosensitive drum 1, exposure is performed so that the image exposure portion has a voltage of −150 V, and a voltage of −350 V is applied to the developing apparatus 6. Here, the potential difference Vback at the time of the cleaning sequence is 350 V which is larger than that in the development concurrent cleaning. Furthermore, a performance time for one cleaning sequence is approximately 7 seconds.

Figure 7:
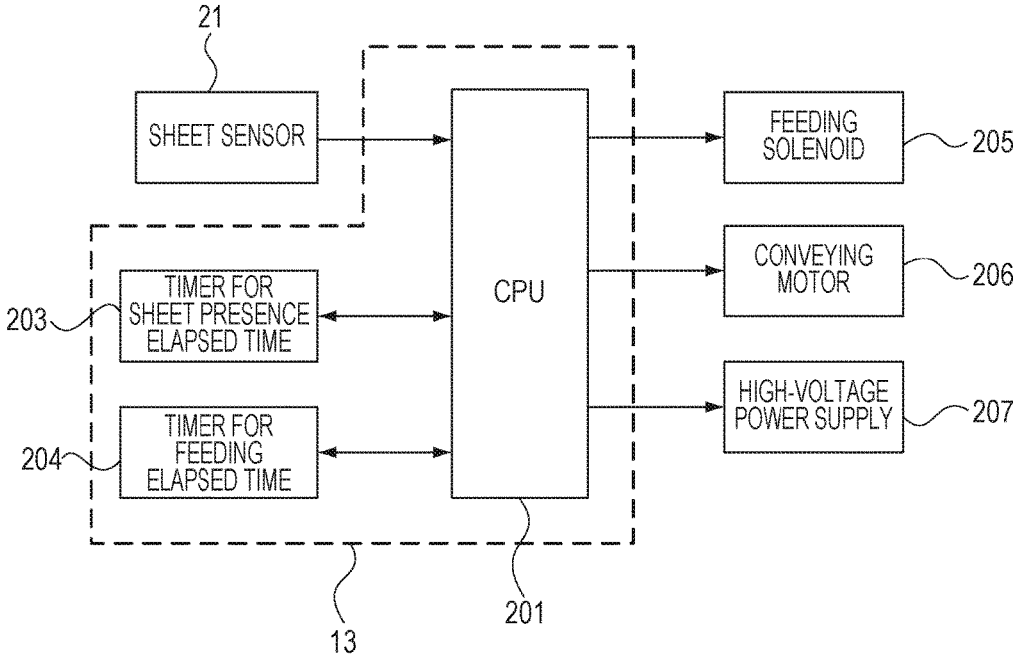
FIG. 7 is a block diagram of main functions of the image forming apparatus according to the fourth and sixth embodiments.

FIG. 7 is a block diagram of main functions of the image forming apparatus according to the fourth embodiment. In FIG. 7, components the same as those illustrated in FIG. 6 are denoted by reference numerals the same as those of FIG. 6. A CPU 201 controls the image forming apparatus. The controller 13 of FIG. 1 includes the CPU 201, a timer 203 for sheet presence elapsed time, and a timer 204 for feeding elapsed time which are illustrated in FIG. 2. A sheet sensor 21 is a detection unit which detects the transfer member 9 on the sheet tray T and outputs a result of a determination as to whether the transfer member 9 is placed on the sheet tray T to the CPU 201. The timer 203 for sheet presence elapsed time is a second time measurement unit which measures a period of time after the sheet sensor 21 detects a sheet, that is, the timer 203 for sheet presence elapsed time measures a period of time in which the sheet sensor 21 detects a sheet. The timer 203 for sheet presence elapsed time indicates 0 while the sheet sensor 21 does not detect a sheet whereas the timer 203 for sheet presence elapsed time indicates t1 when a measurement time representing that a sheet exists is equal to or larger than a predetermined period of time t1. The predetermined period of time t1 is experimentally obtained taking an amount of dust deposited on the transfer member 9 on the sheet tray T into consideration, and an image defect is seen not to occur by an amount of deposition of dust within the predetermined period of time t1. The predetermined period of time t1 is 18 hours in this embodiment. A feeding solenoid 205 is driven by a feeding driving signal supplied from the CPU 201. When the feeding solenoid 205 is driven, the feeding roller 14 starts an operation of selecting one of the transfer members 9 on the sheet tray T and supplying the transfer member 9 into the image forming apparatus. The timer 204 for feeding elapsed time is a first measurement unit which measures a time of the image forming operation and measures a period of time after the CPU 201 outputs the feeding driving signal in this embodiment. When the measurement time after the feeding driving signal is output is equal to or longer than the predetermined period of time t1, the timer 204 for feeding elapsed time outputs t1. A conveying motor 206 is driven by a driving signal supplied from the CPU 201 and serves as a driving source for rotating rollers, such as the conveying rollers 15*a* and 15*b* illustrated in FIG. 6. A high-voltage power source 207 includes a power source (not illustrated) which outputs a high voltage to be supplied to the power source 3, the power source 4, and the developing sleeve 6*a* illustrated in FIG. 6 in accordance with a high-voltage driving signal supplied from the CPU 201.

Figure 8A:
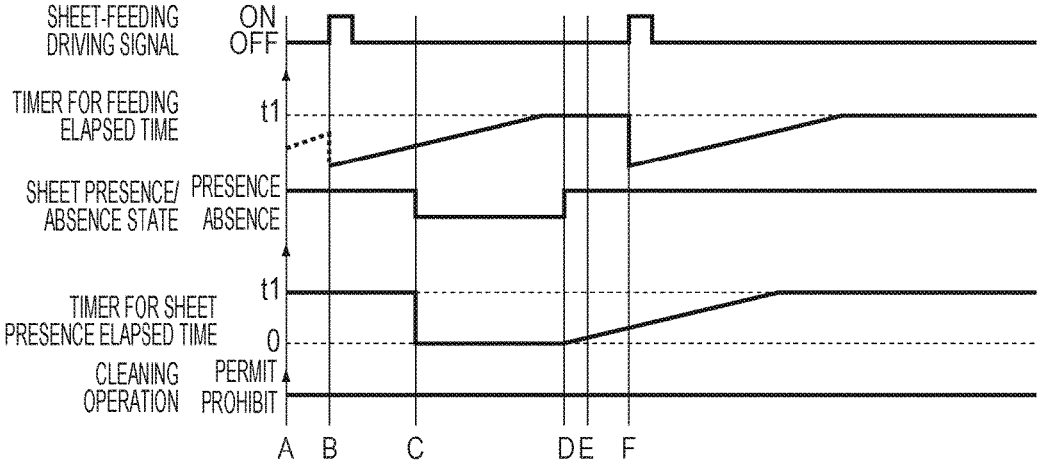
Figure 8B:
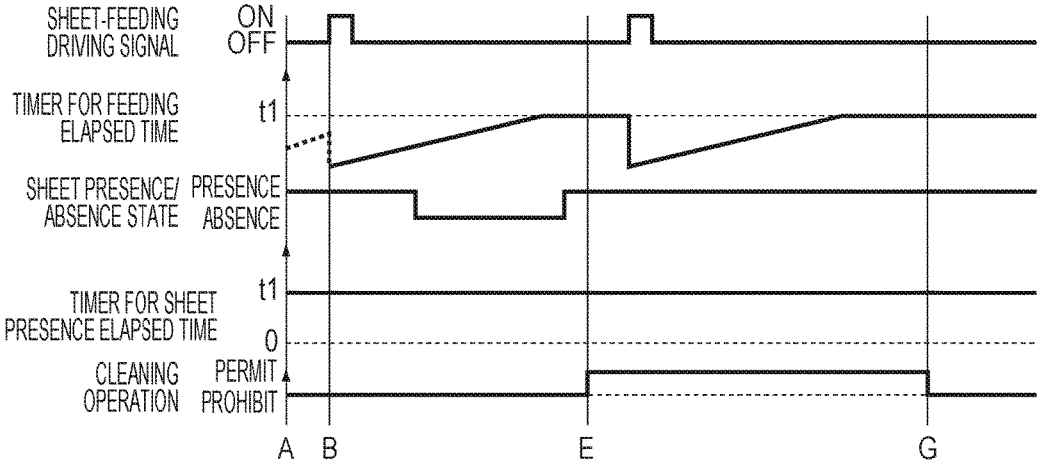
Figure 8C:
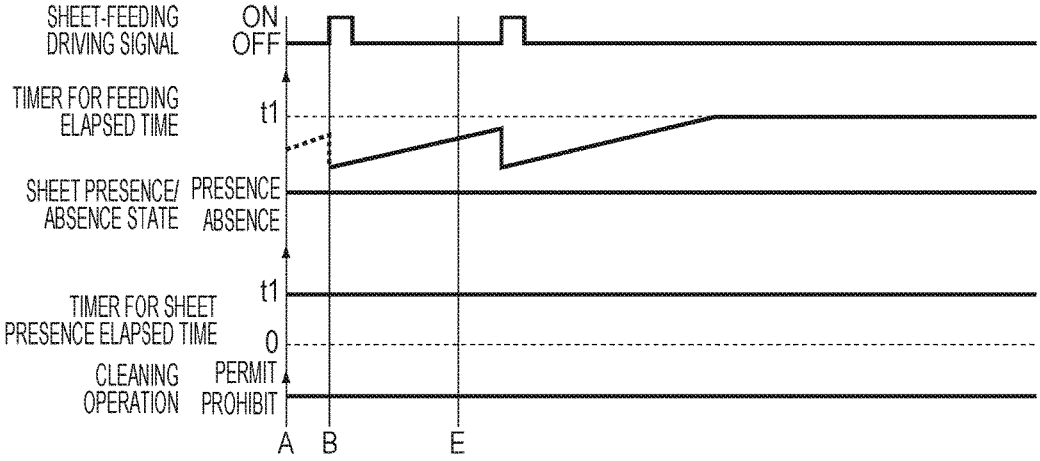

Next, a flow of permission for performing the cleaning sequence (the cleaning operation) according to the fourth embodiment will be described with reference to FIGS. 8A to 8C, FIG. 9 and FIG. 10. FIGS. 8A to 8C are diagrams illustrating the relationships among the feeding solenoid driving signal, the timer 204 for feeding elapsed time, a detection state of the sheet sensor 21, the timer 203 for sheet presence elapsed time, and permission/prohibition of the cleaning sequence. Note that the CPU 201 included in the controller 13 serving as a control unit controls an operation described below in accordance with times measured by the timer 203 for sheet presence elapsed time and the timer 204 for feeding elapsed time.

In FIGS. 8A to 8C, certain printing is instructed at a timing A. It is assumed here that the timer 204 for feeding elapsed time indicates a time shorter than the predetermined period of time t1. Since the feeding elapsed time is shorter than t1, and the cleaning sequence is not permitted. At a timing B, sheet feeding is instructed in response to a printing instruction issued at the timing A. At a timing C, the sheet tray T runs out of the transfer member 9, and therefore, the sheet sensor 21 does not detect the transfer member 9. At a timing D, a transfer member 9 is set on the sheet tray T, and therefore, the sheet sensor 21 detects the transfer member 9. Note that only the case of FIG. 8A includes a state in which a sheet is not detected, and a sheet is constantly detected in the cases of FIGS. 8B and 8C.

At a timing E, next printing is instructed. At a timing F, sheet feeding is instructed in response to the next printing instruction. At a timing G, the cleaning sequence is terminated.

Figure 9:
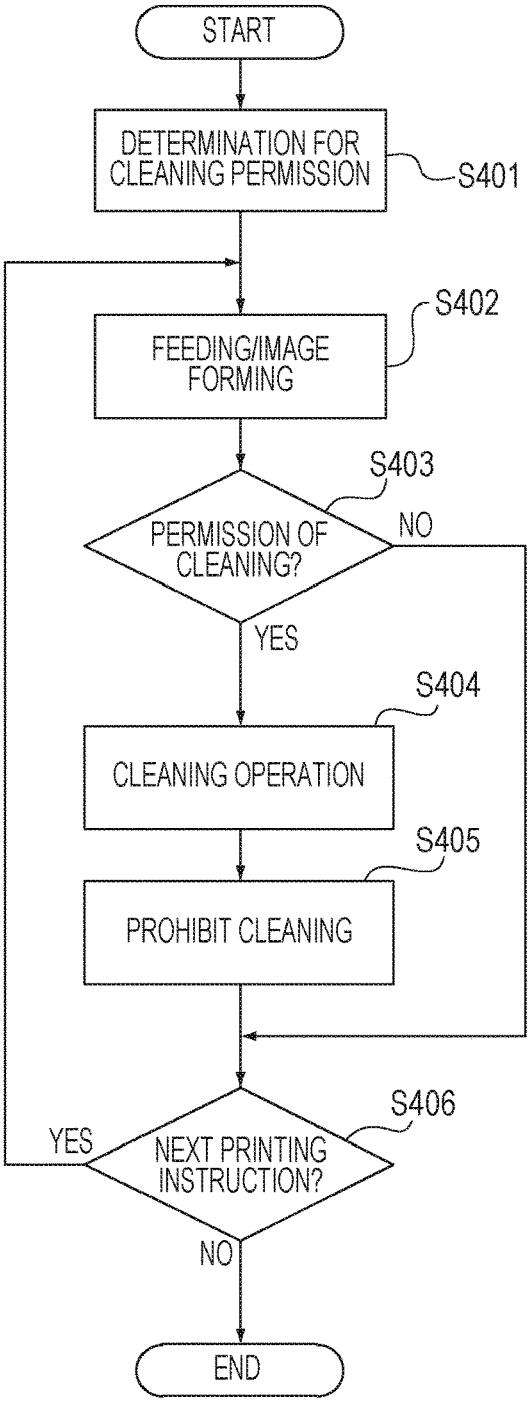
FIG. 9 is a flowchart of control according to the fourth and sixth embodiments.
Figure 10:
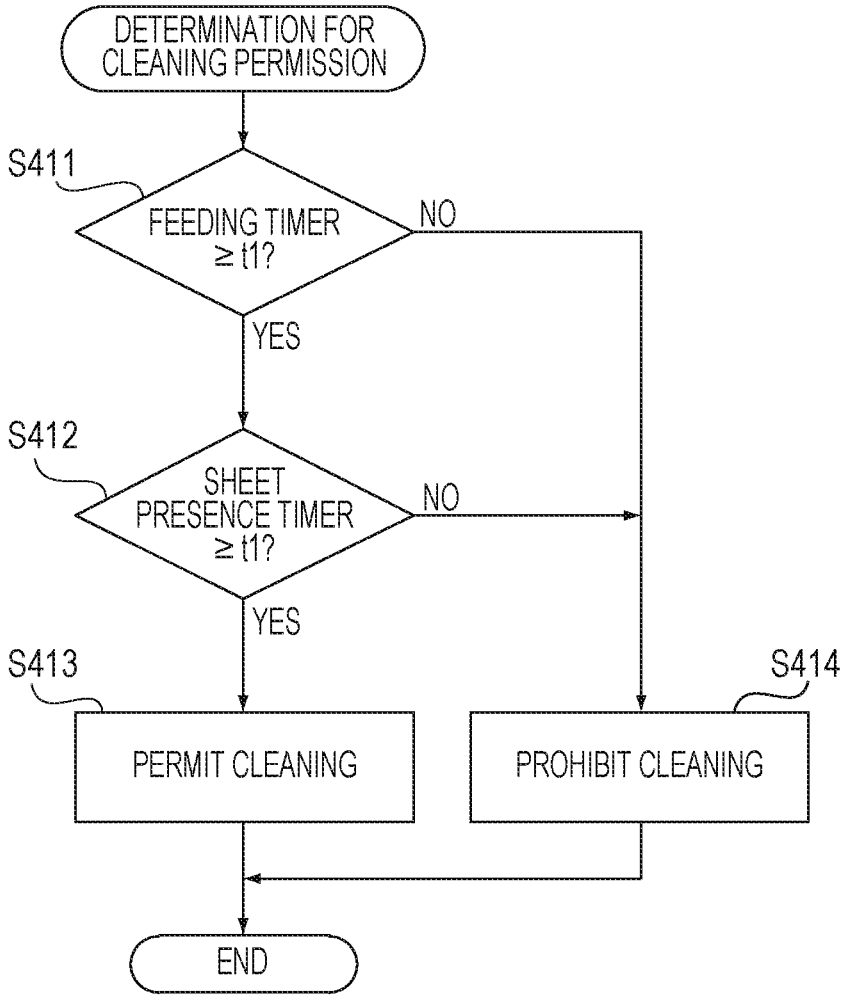
FIG. 10 is a flowchart of control according to the fourth and sixth embodiments.

FIG. 9 is a control flowchart of the CPU 201 performed when printing is instructed. When printing is instructed, a determination for permission of the cleaning sequence is performed (S401). A flow of the cleaning permission determination is illustrated in FIG. 10, and determinations performed by the CPU 201 at the timing E in the various cases of FIGS. 8A to 8C are described. Note that, in FIG. 10, the timer 204 for feeding elapsed time is referred to as a "feeding timer", and the timer 203 for sheet presence elapsed time is referred to as a "sheet presence timer".

In the case of FIG. 8A, although the timer 204 for feeding elapsed time indicates the predetermined period of time t1 (S411), the timer 203 for sheet presence elapsed time indicates a time shorter than the predetermined period of time t1 (S412), and therefore, the cleaning is prohibited (S414). Specifically, since a smaller one of the measurement times measured by the timer 204 for feeding elapsed time and the timer 203 for sheet presence elapsed time is shorter than the predetermined period of time t1, the cleaning operation of cleaning a surface of the photosensitive drum 1 performed by the developing apparatus 6 is prohibited. In the case of FIG. 8B, although the timer 204 for feeding elapsed time and the timer 203 for sheet presence elapsed time indicate the predetermined period of time t1 (S411 and S412), the cleaning is permitted (S413). Specifically, since a smaller one of the measurement times measured by the timer 204 for feeding elapsed time and the timer 203 for sheet presence elapsed time is equal to or longer than the predetermined period of time t1, the cleaning operation is permitted. In the case of FIG. 8C, since the timer 204 for feeding elapsed time is shorter than the predetermined period of time t1 (S411), the cleaning is prohibited (S414). Specifically, since a smaller one of the measurement times measured by the timer 204 for feeding elapsed time and the timer 203 for sheet presence elapsed time is shorter than the predetermined period of time t1, the cleaning operation is prohibited.

When permission or prohibition of the cleaning is determined, the CPU 201 instructs feeding of the transfer member 9 and performs image formation (S402). After the image formation is performed on a first transfer member 9, the CPU 201 determines whether the cleaning is permitted (S403). When the determination is affirmative, the cleaning sequence is performed (S404), and thereafter, the cleaning is prohibited (S405). On the other hand, when the determination is negative in step S403, the cleaning sequence is not performed. At this time point, it is determined whether an instruction for next printing has been issued. When the determination is negative, the printing operation is terminated, and otherwise, supply of a next transfer member 9 (a second transfer member 9 onwards) is started (S406).

Although the predetermined period of time t1 is 18 hours in this embodiment taking an amount of dust deposited on the transfer member 9 into consideration, the present invention is not limited to this. An appropriate value is to be set to the predetermined period of time t1 depending on a type of the apparatus taking a configuration of the sheet tray T and an exposure area of the transfer member 9 set on the sheet tray T into consideration.

As described above, since the image forming apparatus according to this embodiment may perform the cleaning sequence in appropriate frequency, waste of time caused by performance of an unrequired cleaning sequence may be reduced and occurrence of an image defect, in particular, white spots or black spots, may be reduced.

Fifth Embodiment

Figure 11:
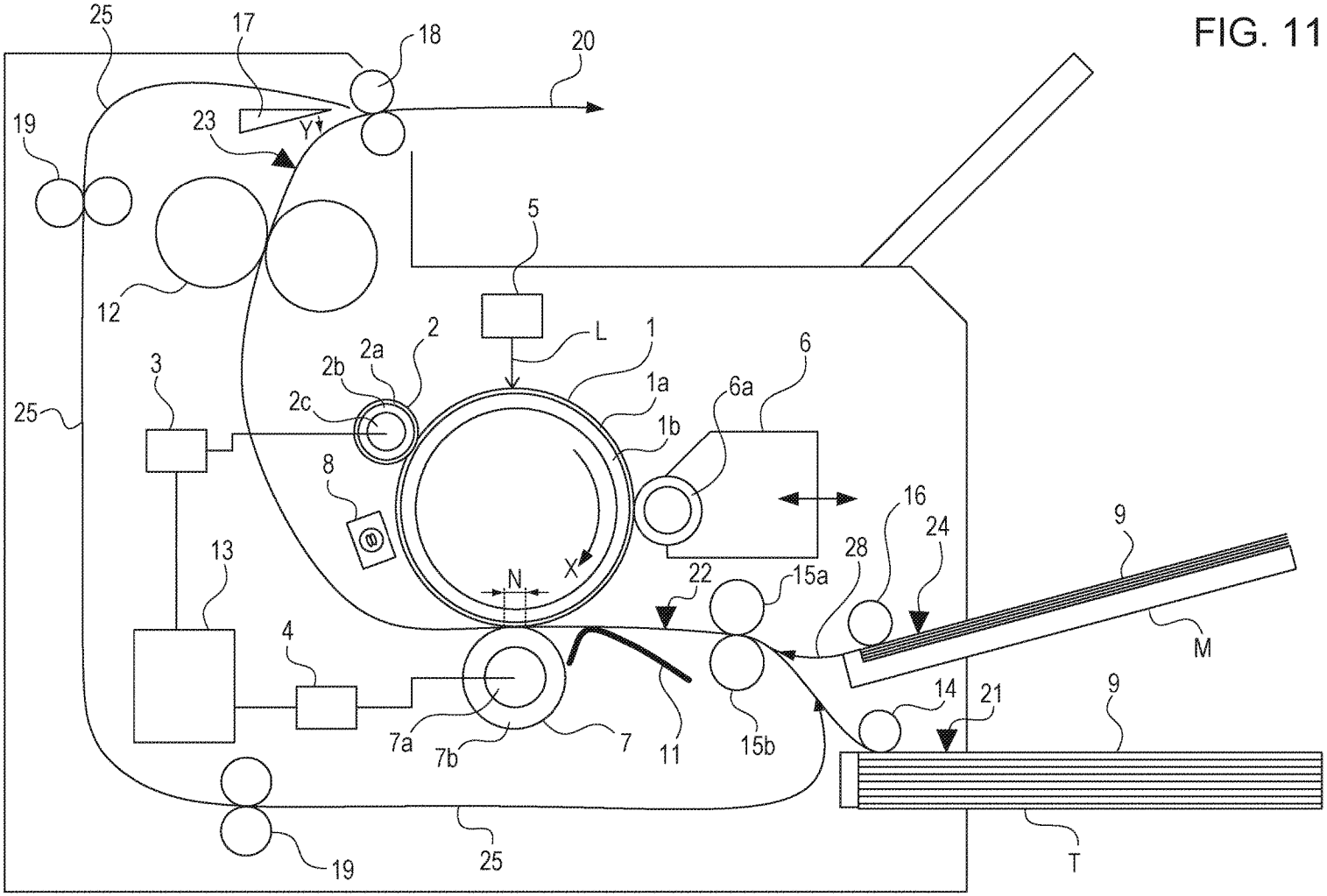
FIG. 11 is a sectional view of a main part of an image forming apparatus according to a fifth embodiment.
Figure 12:
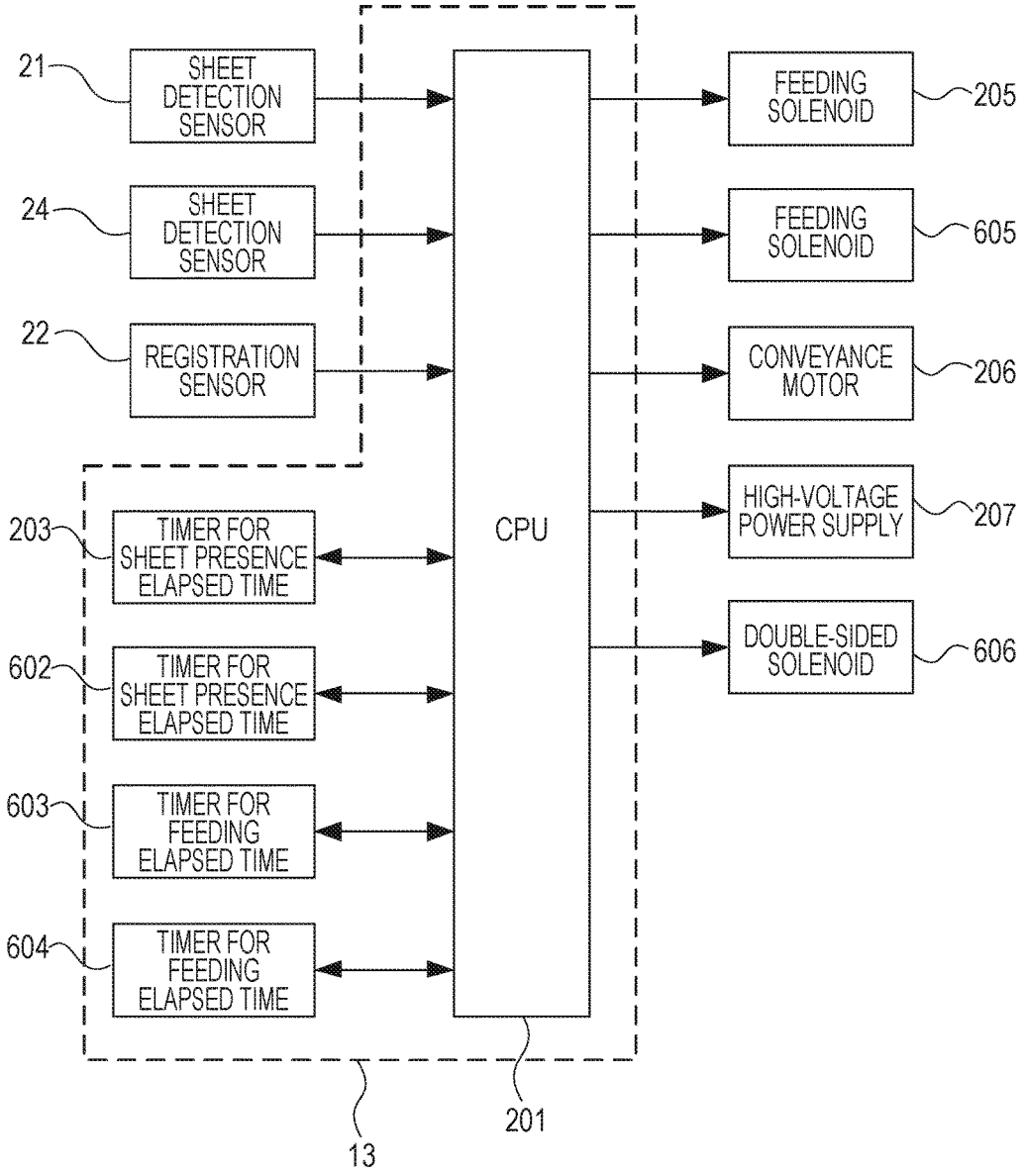
FIG. 12 is a block diagram of main functions of the image forming apparatus according to the fifth embodiment.

Next, an image forming apparatus according to a fifth embodiment will be described with reference to FIGS. 11 and 12. FIG. 11 is a cross sectional view of a main portion of the image forming apparatus according to the fifth embodiment, and FIG. 12 is a block diagram of main functions of the image forming apparatus according to the fifth embodiment. Note that functions the same as those of the fourth embodiment are denoted by reference numerals the same as those in FIGS. 6 and 7, and descriptions thereof are omitted.

As with the third embodiment described above, the image forming apparatus according to this embodiment has a plurality of carrying members which carry transfer members 9. Here, a sheet tray T is illustrated as a first carrying member and a multi-size tray M is illustrated as a second carrying member. Furthermore, each of the carrying members includes a timer for feeding elapsed time (a first time measurement unit), a timer for sheet presence elapsed time (a second time measurement unit), and a sheet sensor (a detection unit).

A multi-size tray M may hold (carry) a small number of transfer members 9 separately from the sheet tray T. One of the trays to be used is instructed when a printing instruction is issued. When the multi-size tray M is selected, a CPU 201 outputs a driving signal to a feeding solenoid 605, and when the sheet tray T is selected, the CPU 201 outputs a driving signal to the feeding solenoid 205 so that the transfer member 9 is supplied from the selected tray using a feeding roller. Then the CPU 201 measures periods of time using the timer for feeding elapsed time (the first time measurement unit) and the timer for sheet presence elapsed time (the second time measurement unit) which correspond to the selected one of the trays.

A sheet sensor 24 is a detection unit which detects the transfer member 9 on the multi-size tray M and outputs a result of a determination as to whether the transfer member 9 is placed on the multi-size tray M to the CPU 201. A registration sensor 22 is disposed on an upstream side in a conveying direction of the transfer member 9 relative to a photosensitive drum 1 on a conveying path 20 and outputs a result of a determination as to whether the transfer member 9 exists in a position of the registration sensor 22. The timer 602 for sheet presence elapsed time is the second time measurement unit which measures a period of time after the sheet sensor 24 detects a sheet, that is, the timer 602 for sheet presence elapsed time measures a period of time in which the sheet sensor 24 maintains a sheet presence state. The timer 602 for sheet presence elapsed time indicates 0 while the sheet sensor 24 does not detect a sheet whereas the timer 602 for sheet presence elapsed time indicates t3 when a measurement time representing the sheet presence state is equal to or larger than a predetermined period of time t3. The predetermined period of time t3 is experimentally obtained taking an amount of dust deposited on the transfer member 9 on the multi-size tray M into consideration, and an image defect is seen not to occur by an amount of deposition of dust within the predetermined period of time t3. The predetermined period of time t3 is 18 hours in this embodiment. A feeding solenoid 605 is driven by a feeding driving signal supplied from the CPU 201. When the feeding solenoid 605 is driven, the feeding roller 16 starts an operation of selecting one of the transfer members 9 on the multi-size tray M and supplying the transfer member 9 into the image forming apparatus. A timer 603 for feeding elapsed time (a first time measurement unit) measures a period of time after the transfer member 9 is supplied and reaches the registration sensor 22 in the printing operation instructed to use the sheet tray T. The timer 603 for feeding elapsed time is cleared when the transfer member 9 is supplied and reaches the registration sensor 22, and when the period of time is equal to or longer than t2, the timer 603 for feeding elapsed time indicates t2. The predetermined period of time t2 is experimentally obtained taking an amount of dust deposited on the transfer member 9 on the sheet tray T into consideration, and an image defect is seen not to occur by an amount of deposition of dust within the predetermined period of time t2. The predetermined period of time t2 is 18 hours in this embodiment. A timer 604 for feeding elapsed time (a first time measurement unit) measures a period of time after the transfer member 9 is supplied and reaches the registration sensor 22 in the printing operation instructed to use the multi-size tray M. The timer 604 for feeding elapsed time is cleared when the transfer member 9 is supplied and reaches the registration sensor 22, and when the period of time is equal to or longer than t2, the timer 604 for feeding elapsed time indicates t2.

A double-sided solenoid 606 is driven in accordance with a double-sided solenoid driving signal output from the CPU 201. When the double-sided solenoid 606 is driven, a discharge roller 18 is reversed, a switching member 17 is guided in a direction indicated by an arrow mark Y of FIG. 11, and the transfer member 9 on the conveying path 20 is guided in a direction of a double-sided conveying path 25. A discharge roller 18 and a switching member 17 are reverse operation units which performs reverse of two sides of the transfer member 9. The transfer member 9 which has been guided to the double-sided conveying path 25 is conveyed on a rear side and a lower side of an apparatus body along the double-sided conveying path 25 and joins in the conveying path 20 again immediately before the conveying rollers 15*a* and 15*b*. At this time, when a surface of the transfer member 9 on the photosensitive drum 1 side which passes a transfer portion N in a first time becomes a surface on the transfer roller 7 side when passing the transfer portion N in a second time, and therefore, double-sided printing is available.

Note that a double-sided conveying roller 19 rotates such that the transfer member 9 on the double-sided conveying path 25 is conveyed in a forward direction of the double-sided conveying path 25 irrespective of a driving state of the double-sided solenoid 606.

Figure 13:
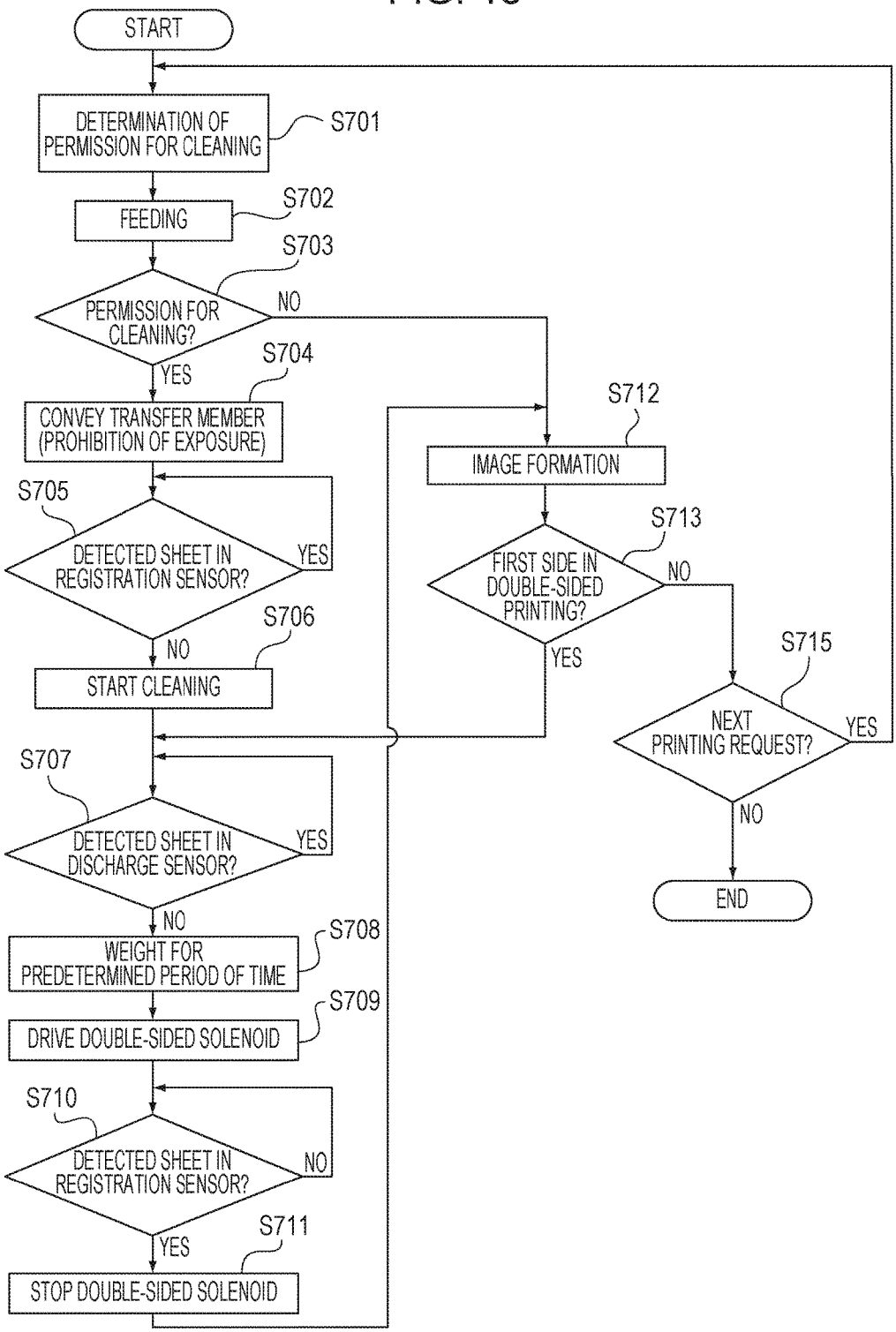
FIG. 13 is a flowchart of control according to the fifth embodiment.

FIG. 13 is a control flowchart of the CPU 201 performed when printing is instructed. The CPU 201 performs a cleaning permission determination first when receiving a printing instruction. The permission determination will be described in detail hereinafter with reference to FIG. 14. Thereafter, a feeding operation is performed from a specified one of the plurality of trays (S702). When the cleaning is permitted, exposure is prohibited while high-voltage power sources maintain output states the same as that in the image formation, and the conveyance of the transfer member 9 is continued while a latent image is not formed on the photosensitive drum 1 (S704). Thereafter, the CPU 201 waits for a state in which a trailing edge of the transfer member 9 passes the registration sensor 22 so that the registration sensor 22 does not detect a sheet (S705). When the registration sensor 22 determines that a sheet does not exist, the cleaning sequence is started. Specifically, when the cleaning is permitted, the transfer member 9 passes the transfer portion N without performing the image forming operation on a first surface.

Setting values in the cleaning sequence and high voltages in the image formation are the same as those of the fourth embodiment, and a performance time of the cleaning sequence is approximately 7 seconds. After the cleaning sequence is terminated, the high voltage at the time of image formation is set again.

The conveyance of the transfer member 9 is continued in parallel to the execution of the cleaning sequence, and the double-sided solenoid 606 is driven when a predetermined period of time has passed after a discharge sensor 23 detects the trailing edge of the transfer member 9 so that the transfer member 9 is conveyed to the double-sided conveying path 25 (S707, S708, and S709). Thereafter, when a leading edge of the transfer member 9 reaches the registration sensor 22 and the registration sensor 22 detects the sheet (S710), the driving of the double-sided solenoid 606 is stopped (S711). Note that, at this time point, the trailing edge of the transfer member 9 has passed the discharge roller 18 taking a length of the double-sided conveying path 25 and a length of the transfer member 9 on which the double-sided printing is available into consideration, and the cleaning sequence has been terminated taking the relationship between a length of the double-sided conveying path 25 and a transfer member conveying speed into consideration.

Thereafter, image formation is performed on the first transfer member 9 (S712). In a case of double-sided printing (S713), a process from step S707 to step S711 is further performed. In a case where the double-sided printing is not performed (S713) or when a second plane has been subjected to the double-sided printing, it is determined whether a next print request (a second print request onwards) exists (S715). When the determination is affirmative, the process from the cleaning permission determination (S701) is performed.

Figure 14:
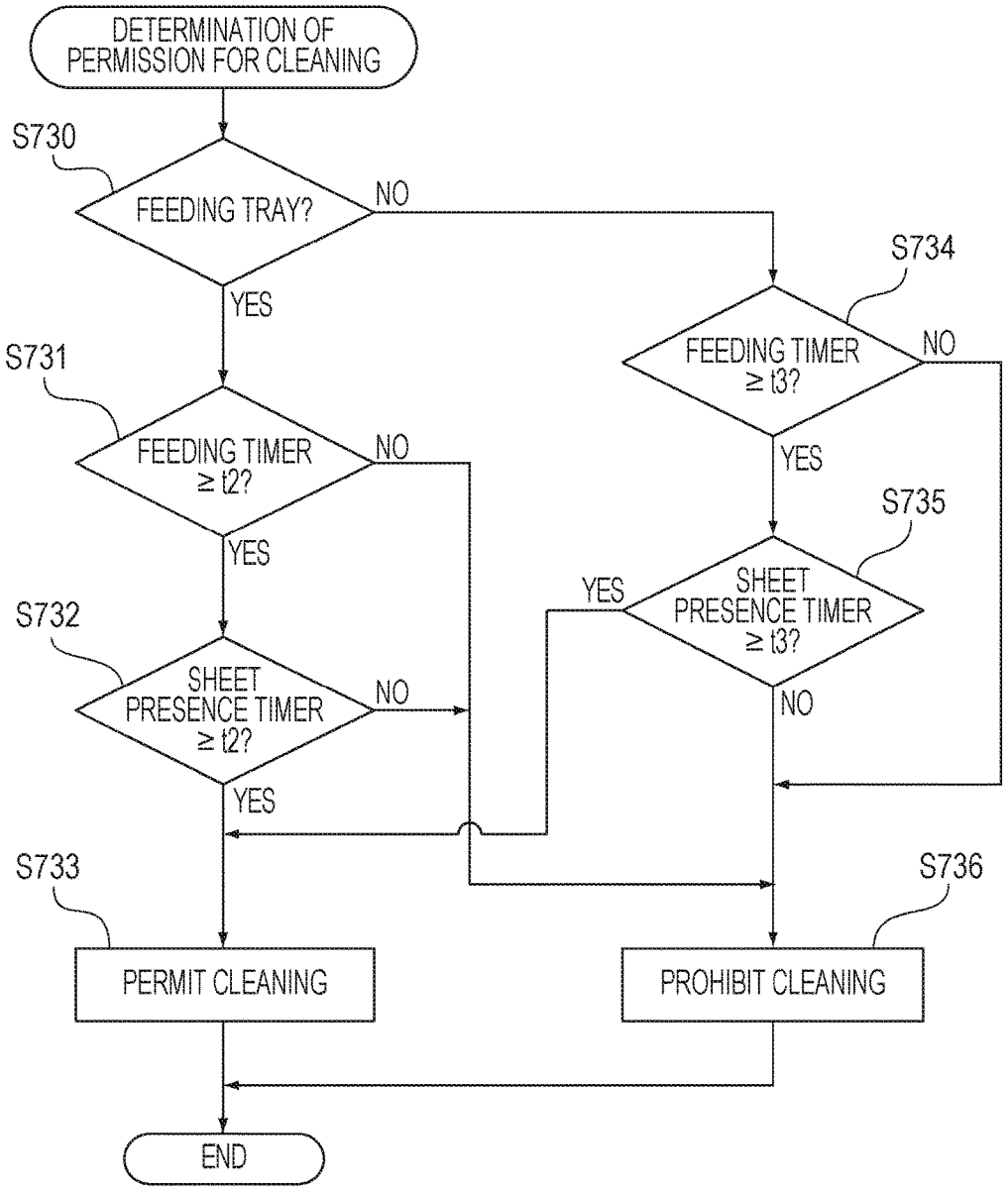
FIG. 14 is a flowchart of control according to the fifth embodiment.

FIG. 14 is a diagram illustrating the cleaning permission determination in detail. Note that, in FIG. 14, as with the case of FIG. 10, the timer 204 for feeding elapsed time is referred to as a "feeding timer", and the timer 203 for sheet presence elapsed time is referred to as a "sheet presence timer". The CPU 201 determines one of the trays corresponding to the printing instruction (S730). When the printing is to be performed using the sheet tray T, values of the timer 603 for feeding elapsed time and the timer 203 for sheet presence elapsed time are checked (S731 and s732). When both of measurement times of the timers are equal to or longer than the predetermined time t2, the cleaning is permitted (S733), and otherwise, the cleaning is prohibited (S736). When the printing is to be performed using the multi-size tray N, values of the timer 604 for feeding elapsed time and the timer 602 for sheet presence elapsed time are checked (S734 and S735). When both of measurement times of the timers are equal to or longer than the predetermined time t3, the cleaning is permitted (S733), and otherwise, the cleaning is prohibited (S736).

Furthermore, the predetermined periods of time t2 and t3 are 18 hours in this embodiment taking an amount of dust deposited on the transfer member 9 into consideration. However, in a case where a volume of dust on the sheet tray T and that on the multi-size tray M are different from each other or the like, different values may be preferably set. Furthermore, as with the fourth embodiment, an appropriate value is to be set to the predetermined period of time t1 depending on a type of the apparatus taking configurations of the trays and an exposure area of the transfer member 9 set on the sheet tray T into consideration.

In the case of printing using the sheet tray T, the value of the timer 603 for feeding elapsed time is cleared when the transfer member 9 reaches the registration sensor 22. In the case of printing using the multi-size tray M, the value of the timer 604 for feeding elapsed time is cleared when the transfer member 9 reaches the registration sensor 22. Therefore, in consecutive printing performed once, substantially two cleaning operations are performed at most, and further cleaning operations are not performed.

As described above, since the cleaning sequence may be performed in appropriate frequency, waste of time caused by performance of an unrequired cleaning sequence may be reduced and occurrence of an image defect, in particular, white spots or black spots, may be reduced in the image forming apparatus. Furthermore, according to this embodiment, the image forming apparatus which reduces a risk that dust attached on a front portion of the transfer member 9 in a conveying direction is attached to the photosensitive drum 1 and the dust causes an image defect in a rear portion of the transfer member 9 may be provided.

Sixth Embodiment

Next, an image forming apparatus according to a sixth embodiment will be described with reference to FIG. 15. A cross-sectional view of a main portion of the image forming apparatus and a block diagram of main functions of the image forming apparatus according to the sixth embodiment are the same as those of the fourth embodiment, and therefore, FIGS. 6, 7, 9, and 10 are used and detailed descriptions thereof are omitted.

Figure 15:
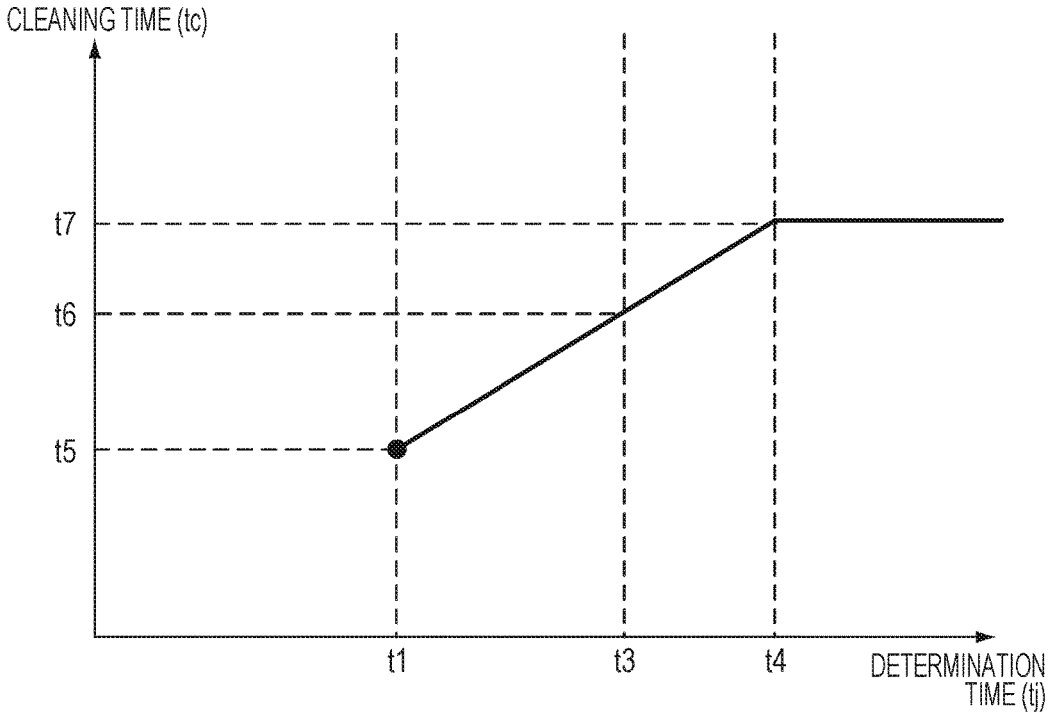
FIG. 15 is a cleaning time determination table according to the sixth embodiment.

FIG. 15 s a table for determining a cleaning time (a performance time) when the CPU 201 determines that the cleaning is permitted in step S413 of FIG. 10. A determination time tj corresponds to a smaller one of values of the timer 203 for sheet presence elapsed time and the timer 204 for feeding elapsed time, and is not smaller than t1 since the cleaning permission is determined.

When the determination time tj is t1, a cleaning time tc is t5 as illustrated in FIG. 15, and when the determination time tj is t4, a cleaning time tc is t7. A cleaning time t6 in a case where the determination time is t3 (which is equal to or larger than t1 and smaller than t4) may be obtained by the following equation: $t6=(t7-t5)*(t3-t1)/(t4-t1)+t5$.

Here, when the determination time tj is equal to or larger than t4, a cleaning time is fixed to t7 since it is determined that a sufficient cleaning effect of this embodiment is obtained in the cleaning time t7 when the cleaning sequence is continued. However, the cleaning time may not be restricted by a time tolerant to the cleaning sequence or not saturated, and a table in which the cleaning time tc is increased in accordance with increase of the determination time may be employed.

The cleaning time tc indicates a period of time in which settings of high voltages are set to a predetermined voltage during the cleaning sequence. The setting values of the high voltages in the cleaning sequence and in the image formation are the same as those of the fourth embodiment.

In this embodiment, t1 is 18 hours, t4 is 72 hours, t5 is 7 seconds, and t7 is 14 seconds, for example. However, the values are not limited to these and appropriate values may be set taking a configuration of the sheet tray T and an exposure area of the transfer member 9 which is set on the sheet tray T into consideration.

As described above, the cleaning sequence may be performed in appropriate frequency for a required period of time. Therefore, an image forming apparatus capable of reducing waste of time caused by an unrequired cleaning sequence and an image defect (in particular, generation of white spots and black spots) may be provided.

Other Embodiment

Although a printer is illustrated as an image forming apparatus in the foregoing embodiments, the present invention is not limited to this. An image forming apparatus may be a copier, a facsimile, or the like or may be multifunction peripheral having these functions combined with each other. The same effect may be obtained by employing the present technique in these image forming apparatuses.

Furthermore, although a sheet is fed from a tray which is integrally disposed on the image forming apparatus, the present invention is not limited to this. For example, the same effect may be obtained when the present invention is employed in a configuration in which a sheet is fed from a tray of a sheet feeding device which is detachably attached to the image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-143918 filed Jul. 22, 2016, which is hereby incorporated by reference herein in its entirety.

What is claimed is:

1. An image forming apparatus including a developing unit which forms a toner image on a surface of a photosensitive member and which collects toner which remains on the surface of the photosensitive member after the developed toner image is transferred to a transfer member, the image forming apparatus comprising:

a memory that stores a set of instructions;

at least one processor that is in communication with the memory, the processor executes the instructions to:

perform a cleaning operation for cleaning the surface of the photosensitive member when a measured downtime of the image forming apparatus, which is a period of time after an image forming operation for forming the toner image is terminated and before a next image forming operation is started, is equal to or longer than a predetermined period of time, and to not perform the cleaning operation when the measured downtime is shorter than the predetermined period of time.

2. The image forming apparatus according to claim 1, wherein the processor performs the cleaning operation for a first performance time when the measured downtime is equal to or longer than a first predetermined period of time and performs the cleaning operation for a second performance time which is longer than the first performance time when the measured downtime is longer than a second predetermined period of time which is longer than the first predetermined period of time.

3. The image forming apparatus according to claim 1, further comprising:

at least one carrying member having a carrying surface which carries a transfer member and which is exposed out of the image forming apparatus, wherein the processor performs the cleaning operation when a transfer member is fed from the carrying member having the carrying surface which carries the transfer member and which is exposed out of the image forming apparatus.

4. An image forming apparatus including a developing unit which forms a toner image on a surface of a photosensitive member and which collects toner which remains on the surface of the photosensitive member after the developed toner image is transferred to a transfer member, the image forming apparatus comprising:

a memory that stores a set of instructions;

at least one processor that is in communication with the memory, the processor executes the instructions to:

perform a cleaning operation for cleaning the surface of the photosensitive member when a measured feeding interval, which is a period of time after a certain sheet feeding operation is terminated and before a next sheet feeding operation is started when a transfer member is fed from a carrying member having a carrying surface which carries the transfer member and which is exposed out of the image forming apparatus, exceeds a predetermined period of time and, to not perform the cleaning operation when the measured feeding interval does not exceed the predetermined period of time.

5. The image forming apparatus according to claim 4, wherein the processor performs the cleaning operation for a first performance time when the measured feeding interval exceeds a first predetermined period of time and performs the cleaning operation for a second performance time which is longer than the first performance time when the measured feeding interval exceeds a second predetermined period of time which is longer than the first predetermined period of time.

6. An image forming apparatus including a developing unit which forms a toner image on a surface of a photosensitive member and which collects toner which remains on the surface of the photosensitive member after the developed toner image is transferred to a transfer member, the image forming apparatus comprising:

a first time measurement unit configured to measure a period of time in which an image forming operation for forming the toner image is performed;

a carrying member configured to carry the transfer member;

a detector configured to detect if the transfer member exist on the carrying member;

a second time measurement unit configured to measure a period of time after the detector detects that the transfer member exist on the carrying member;

a memory that stores a set of instructions; and at least one processor that is in communication with the memory, the processor executes the instructions to:

(1) prohibit a cleaning operation of cleaning the surface of the photosensitive member to be performed by the developing unit when a shorter one of the periods of time measured by the first and second time measurement units is shorter than a predetermined period of time and (2) permit the cleaning operation when the shorter one of the periods of time is equal to or longer than the predetermined period of time, and configured to perform the cleaning operation when the cleaning operation is permitted after an image forming operation performed on a first transfer member is terminated irrespective of a result of a determination as to whether the image forming operation is to be performed on a second transfer member onwards.

7. The image forming apparatus according to claim 6, further comprising:

a plurality of carrying members which carry transfer members, wherein each of the carrying members has the first and second time measurement units and the detector, and the processor prohibits the cleaning operation when a shorter one of the periods of time measured by the first and second time measurement units corresponding to the carrying members which carry transfer members to be used in the image forming operation is shorter than a predetermined period of time, permits the cleaning operation when the shorter one of the periods of time is equal to or longer than the predetermined period of time, and performs the cleaning operation when the cleaning operation is permitted after the image forming operation is performed on a first transfer member irrespective of a result of a determination as to whether the image forming operation is to be performed on a second transfer member onwards.

8. The image forming apparatus according to claim 6, further comprising:

a reverse operation unit configured to perform an operation of reversing a surface of the transfer member, wherein the processor supplies the photosensitive member to the reverse operation unit without performing the image forming operation on the first transfer member before the cleaning operation is performed when the cleaning operation is permitted and conveys the transfer member reversed by the reverse operation unit to the photosensitive member again so as to perform the image forming operation.

9. The image forming apparatus according to claim 8, further comprising:

a plurality of carrying units which carry transfer members, wherein each of the carrying member has the first and second time measurement units and the detector, and the processor prohibits the cleaning operation when a shorter one of the periods of time measured by the first and second time measurement units corresponding to the carrying members which carry transfer members to be used in the image forming operation is shorter than a predetermined period of time, permits the cleaning operation when the shorter one of the periods of time is equal to or longer than the predetermined period of time, supplies the photosensitive member to the reverse operation unit without performing the image forming operation on the first surface of the transfer member before the cleaning operation is performed when the cleaning operation is permitted, and conveys the transfer member reversed by the reverse operation unit to the photosensitive member again so as to perform the image forming operation.

10. The image forming apparatus according to claim 6, wherein the processor determines a performance time of the cleaning operation corresponding to a shorter one of the periods of time measured by the first and second time measurement units before performing the cleaning operation when the cleaning operation is permitted.

* * * * *